US005216471A

United States Patent [19]

Kajita et al.

[11] Patent Number: 5,216,471

[45] Date of Patent: Jun. 1, 1993

[54] IMAGE FORMING APPARATUS AND ROLL PAPER CUTTING DEVICE

[75] Inventors: Hiroshi Kajita, Kobe; Akihiro Kondoh, Sakai; Makoto Sugiura, Osaka; Nobuhiro Nishioka, Osaka; Masahiko Fukano, Osaka; Eiji Gotoh, Higashiosaka; Satoshi Tanaka, Yao; Takeshi Matsuo, Higashiosaka, all of Japan

[73] Assignee: Mita Industrial Co., Ltd., Osaka, Japan

[21] Appl. No.: 615,766

[22] Filed: Nov. 19, 1990

[30] Foreign Application Priority Data

| | | | |
|---|---|---|---|
| Nov. 22, 1989 | [JP] | Japan | 1-303717 |
| Nov. 27, 1989 | [JP] | Japan | 1-308338 |
| Nov. 27, 1989 | [JP] | Japan | 1-308341 |
| Jan. 23, 1990 | [JP] | Japan | 2-14486 |
| Mar. 19, 1990 | [JP] | Japan | 2-70805 |

[51] Int. Cl.[5] ..... G03G 15/00

[52] U.S. Cl. ..... 355/310; 355/311; 355/321; 355/206; 355/200

[58] Field of Search ..... 355/205.7, 310, 311, 355/321; 358/304

[56] References Cited

U.S. PATENT DOCUMENTS

| | | | |
|---|---|---|---|
| 3,922,082 | 11/1975 | Cavallaro et al. | 355/310 |
| 4,265,153 | 5/1981 | Price, Jr. | 83/372 |
| 4,706,099 | 11/1987 | Suzuki | 355/311 X |
| 4,901,118 | 2/1990 | Hamano | 355/310 |

FOREIGN PATENT DOCUMENTS

| | | |
|---|---|---|
| 0175023 | 3/1986 | European Pat. Off. . |
| 2335295 | 1/1974 | Fed. Rep. of Germany . |
| 2047210 | 11/1980 | United Kingdom . |

OTHER PUBLICATIONS

Patent Abstract of Japan, vol. 10, No. 158, (E-409) (2214), 6 Jun. 1986; and JP-A-61-13 864 (Ricoh K.K.) 22-Jan.-1986 (The whole abstract).

Patent Abstracts of Japan, vol. 7, No. 6, (P-167) (1151), 11 Jan. 1983; and JP-A-57-165 858 (Konishiroku Yuubitsukusu K.K.) 13-Oct.-1982 (The whole abstract)

*Copies of the Above-Listed Publications are Enclosed Herewith.*

*Patent Abstract of Japan,* vol. 7, No. 78 (P-188) [1223], 31 Mar. 1983 and JP-A-58 9162 (Ricoh K.K.) 19-Jan-.-1983.

*Primary Examiner*—Joan H. Pendegrass

*Attorney, Agent, or Firm*—Jordan and Hamburg

[57] ABSTRACT

An image forming apparatus has an image forming apparatus main body with a sheet inlet. The main body is arranged to form an image on a sheet inserted into the sheet inlet. A roll paper cutting device contains roll paper and includes a cutting arrangement for cutting the roll paper and discharging cut sheets. The cutting device is attachable to the main body of the apparatus, and is selectively positionable to a feed position where its outlet is in register with the sheet inlet, or a standby position wherein the outlet thereof is out of register with the sheet inlet. A guide arrangement is provided on the main body for guiding the cutting device for movement in the vertical direction between the feed position and the standby position.

27 Claims, 23 Drawing Sheets

IMAGE FORMING APPARATUS AND ROLL PAPER CUTTING DEVICE

BACKGROUND OF THE INVENTION AND RELATED ART STATEMENT

The present invention relates to copying machines or like image forming apparatus for forming copy images, for example, on paper precut to a specified size and a roll paper cutting device for use with the apparatus.

As the means for feeding copy paper to the image forming position, image forming apparatus, such as copying machines, generally have incorporated therein a cassette for containing paper precut to a specified size and delivering the cut paper therefrom one sheet after another. Alternatively, sheets of such cut paper are manually inserted one by one into a copy paper inlet formed in the body of the apparatus.

However, the apparatus for use with such cut paper has the drawback of necessitating a large space for holding the paper therein when the paper to be used has a large size. Accordingly, paper in the form of a roll is usually set in a specific roll paper cutting device, cut to the desired size by the device and then fed to the image forming apparatus through a paper inlet.

This method is cumbersome and inefficient because the roll paper must be cut by the device before an image forming operation. The drawback can be overcome by incorporating a roll paper cutting mechanism into the image forming apparatus, such that when a roll paper mode is selected as the paper feed mode for the apparatus, cut paper is fed from the cutting mechanism. In this case, however, an image forming apparatus having a special and complex construction must be newly fabricated at an increased cost. Furthermore, the user possessing an apparatus not incorporating the cutting mechanism must purchase the new apparatus.

Conventional roll paper cutting devices are adapted to cut roll paper to a predetermined size but are unable to cut the roll paper in conformity with the size of documents fed to the image forming apparatus. Accordingly, the conventional device requires the cumbersome procedure of measuring the size of documents first and feeding the measurement to the cutting device as the desired cutting size.

Further in the case where the image forming apparatus is adapted to be equipped with the roll paper cutting device as an optional device, with signal communication effected to associate the device with the apparatus, the modification of the apparatus and wiring require much labor to impair the optionality. When the roll paper cutting device is to be used as such an optional device, the roll paper feed means within the device and the paper feed means within the apparatus must be adapted to transport paper at the same speed, whereas this encounters extreme difficulty. If there is a difference between the two feed means in transport speed, the roll paper is likely to become deflected or tensioned to produce an adverse effect on the formation of images especially when elongated documents are copied. Further when the two speeds are to be made identical, the drive source for the roll paper feed means, for example, must be finely adjusted, but the means for effecting the fine adjustment is expensive, consequently diminishing the advantage of the image forming apparatus.

SUMMARY OF THE INVENTION

To overcome the foregoing problems, the present invention provides an image forming apparatus comprising an image forming apparatus main body having a sheet inlet and adapted to form an image on a sheet inserted from the sheet inlet, and a roll paper cutting device containing roll paper and adapted to cut the roll paper and discharge the cut sheet to the outside from an outlet, the cutting device being so attachable to the apparatus main body as to be selectively in a feed position where the outlet is in register with the sheet inlet or in a standby position where the outlet is out of register with the sheet inlet.

When the roll paper cutting device of the above apparatus is shifted to the feed position, a sheet of paper cut off from the roll paper by the device can be fed from the outlet into the apparatus body through the sheet inlet thereof. Alternatively, with the roll paper cutting device shifted from the feed position to the standby position, cut paper can be fed to the apparatus main body manually from the sheet inlet thereof. This results in the advantage that images can be formed not only on cut paper but also on roll paper utilizing an existing image forming apparatus and using an inexpensive construction.

The invention further provides a roll paper cutting device attachable to an image forming apparatus main body for forming an image of a document fed to an exposure unit on a sheet and adapted to feed roll paper in a cut state into the apparatus main body, the cutting device comprising a main body containing the roll paper, means for transporting the roll paper, a cutter for cutting the roll paper during transport, rear end detecting means connected to the cutting device main body and provided in the path of transport of documents on the image forming apparatus main body for detecting the rear end of the document, and control means for cutting the roll paper with predetermined timing based on the time when the document rear end is detected by the detecting means.

With the construction described above, the roll paper cutting device main body is attached to the image forming apparatus at its paper feed position, and the rear end detecting means connected to the device main body is provided at a suitable portion of the document transport path of the apparatus main body. The roll paper can then be cut to a size in accordance with the size of a particular document based on the time when the rear end of the document is detected by the rear end detecting means, and the cut sheet can be fed to the image forming apparatus. This results in the advantage that an existing image forming apparatus is usable without any substantial modification in combination with the cutting device as optionally attached thereto for cutting the roll paper to a suitable size in conformity with the document size and feeding the cut sheet to the apparatus. Moreover, this advantage can be obtained regardless of the construction of the image forming apparatus by providing the rear end detecting means at a suitably selected position.

The present invention further provides a roll paper cutting device attachable to an image forming apparatus main body and containing roll paper for cutting the roll paper and feeding the cut sheet to the image forming apparatus, the cutting device comprising at least one transport roller for transporting the roll paper, drive means for driving the transport roller, drive change means for selectively bringing the transport roller into idle rotation or into a driven state, means for detecting the travel of the roll paper, and control means for drivingly rotating all transport rollers with predetermined timing based on the time when the travel of the roll paper is detected with all the transport rollers in idle rotation in a standby state for paper feeding.

With the construction described above, the transport roller is first drivingly rotated, whereby the roll paper in the cutting device is transported to a paper feed portion within the image forming apparatus main body. Subsequently, all transport rollers are allowed to rotate idly in the standby state for paper feeding, and the image forming apparatus is initiated into a paper feed operation in this state, whereupon the roll paper is pulled out, and the travel of the paper is detected. This causes the control means to start to drive the transport rollers with suitable timing, whereby the roll paper is automatically fed to the image forming apparatus. Accordingly, even if there is no communication between the cutting device and the apparatus main body, the feed of the roll paper can be started with suitable timing. As a result, the cutting device can be attached to the apparatus main body by a simple procedure for suitably feeding roll paper to the apparatus main body almost without necessitating modification of the apparatus body, wiring or the like.

The present invention further provides a roll paper cutting device for feeding a cut sheet of roll paper to an image forming apparatus main body having an image forming assembly and transport means provided in a path of transport to the image forming assembly, the cutting device being characterized in that the device comprises transporting means for transporting the roll paper, a cutter for cutting the roll paper, means for detecting the amount of transport of the roll paper, and control means for discontinuing the transport by the transporting means and changing over the transporting means to render the roll paper free to pull out when the amount of transport detected by the detecting means becomes sufficient for the leading end of the roll paper to reach the transport means within the apparatus main body.

With the construction described above, the roll paper is first transported from the roll paper cutting device to the transport means within the image forming apparatus main body by the feed means of the device, whereupon the paper is further transported alternatively by the transport means only. This renders the paper transportable free of objections such as deflection and tension, further obviating the need to finely adjust the drive source for the roll paper cutting device and assuring facilitated control. Consequently, the roll paper can be transported reliably at a low cost.

The above and other objects, features and advantages of the present invention will become more apparent upon a reading of the following detailed description and the drawings.

DESCRIPTION OF THE PREFERRED EMBODIMENTS

Figure 1:
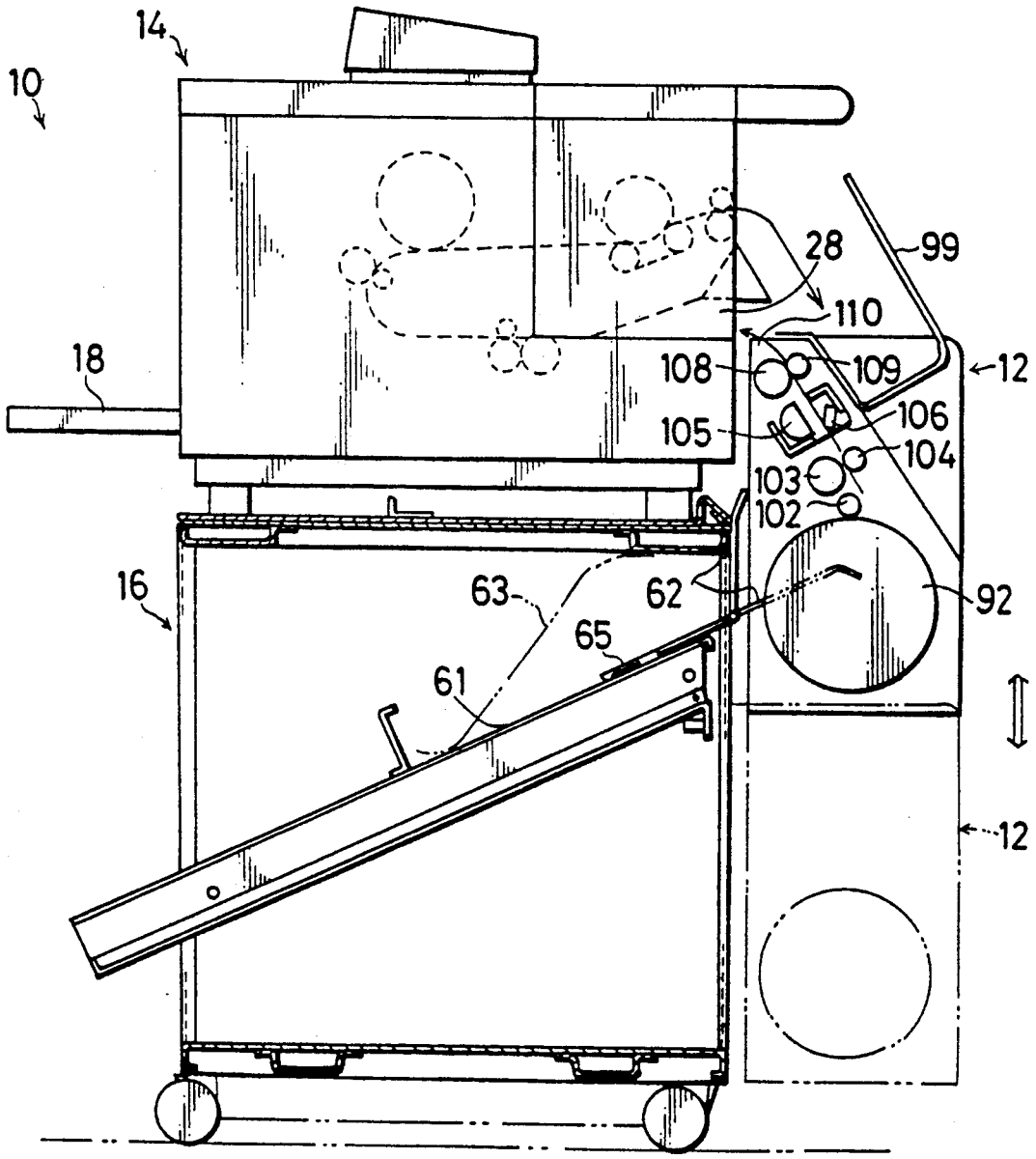
FIG. 1 is a diagram showing the overall construction of a first embodiment of the invention, i.e., an image forming apparatus.

FIG. 1 shows the overall construction of a copying machine (image forming apparatus) embodying the present invention.

The copying machine comprises a main body 10 and a roll paper cutting device 12. The main body 10 comprises a copying assembly 14, and a copy paper stacking frame 16 having the copying assembly 14 supported thereon. The term "roll paper" is herein used not in a narrow sense of the term but includes, for example, roll film for use in preparing second original drawings.

Figure 2:
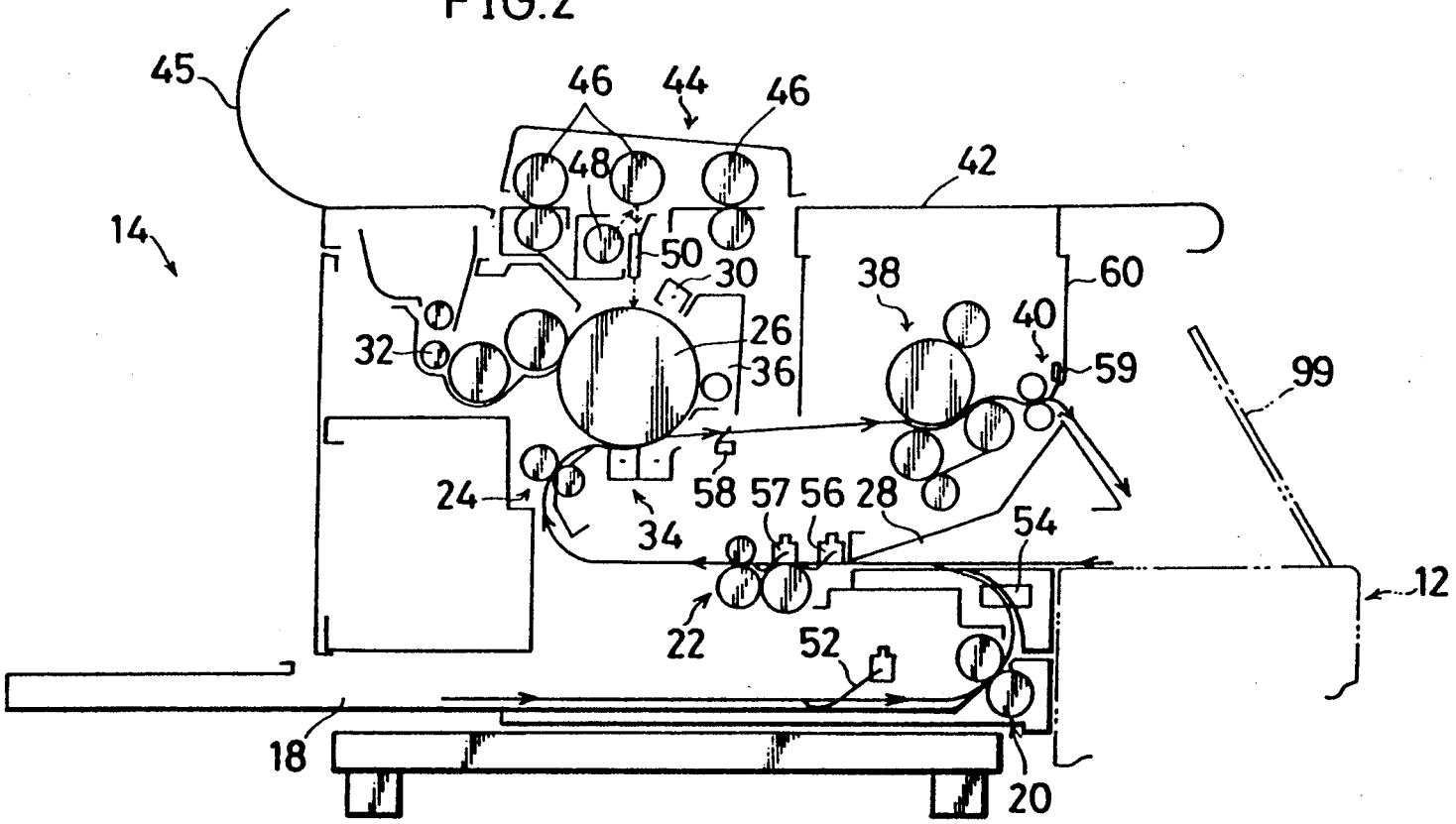
FIG. 2 is a diagram of the interior construction of a copying assembly in the image forming apparatus.

FIG. 2 shows the interior construction of the copying assembly 14, which has in its lower portion a large withdrawable paper cassette (sheet container) 18. The cassette 18 contains copy paper, which is transported to a photosensitive drum 26 at a higher level via pairs of feed rollers 20, 22 and a pair of register rollers 24. At the front side (right-hand side in FIG. 2) of the copying assembly 14, a copy paper inlet 28 is positioned above the cassette 18. Copy paper is also inserted into the inlet 28 and fed to the copying assembly 14 via the pair of feed rollers 22.

Successively arranged around the photosensitive drum 26 in the direction of rotation thereof are a main charger 30, a developing unit 32, the pair of register rollers 24, a transfer-separation unit 34, a cleaner 36, etc. A fixing unit 38 and a pair of discharge rollers 40 are disposed downstream from the drum 26 with respect to the direction of transport of the copy paper, i.e., toward the front side.

At the upper side of the copying assembly 14, a document feed path 42, an exposure unit 44 and a document reversing member 45 are arranged one after another. The exposure unit 44 includes a plurality of rollers 46 for transporting documents, an exposure lamp 48, a lens array 50, etc., whereby an image of the document to be transported is projected onto the drum 26.

Further provided inside the copying assembly 14 are a paper absence switch (sheet detecting means) 52 for detecting whether copy paper is present in the cassette 18, and a cassette insertion switch 54 for detecting whether the cassette 18 has been completely loaded in place.

Jam sensor switches 56 to 59 are arranged at two positions upstream from the pair of transport rollers 20 with respect to the paper transport direction, at a position downstream from the drum 26 and at the position of the pair of discharge rollers 40, respectively. These switches 56 to 59 detect the copy paper passing the respective positions. If each of the switches 56 to 59 fails to detect the copy paper upon lapse of a predetermined period of time after the feed of the copy paper, this is interpreted as indicating occurrence of a jam.

The document feed path 42, transfer-separation unit 34, fixing unit 38, discharge roller pair 40, etc. are accommodated in a common unit housing 60 as a single unitary assembly, which can be withdrawn toward the front in the event of a jam.

The copy paper stacking frame 16 is internally provided with a copy paper stacking tray (stacking portion) 61 slanting upward toward the front side as seen in FIG. 1. The inlet side portion of the tray, i.e., the front side portion thereof, is provided with a copy paper guide plate (guide member) 62 and a support plate 65 as shown also in FIG. 11.

Figure 11:
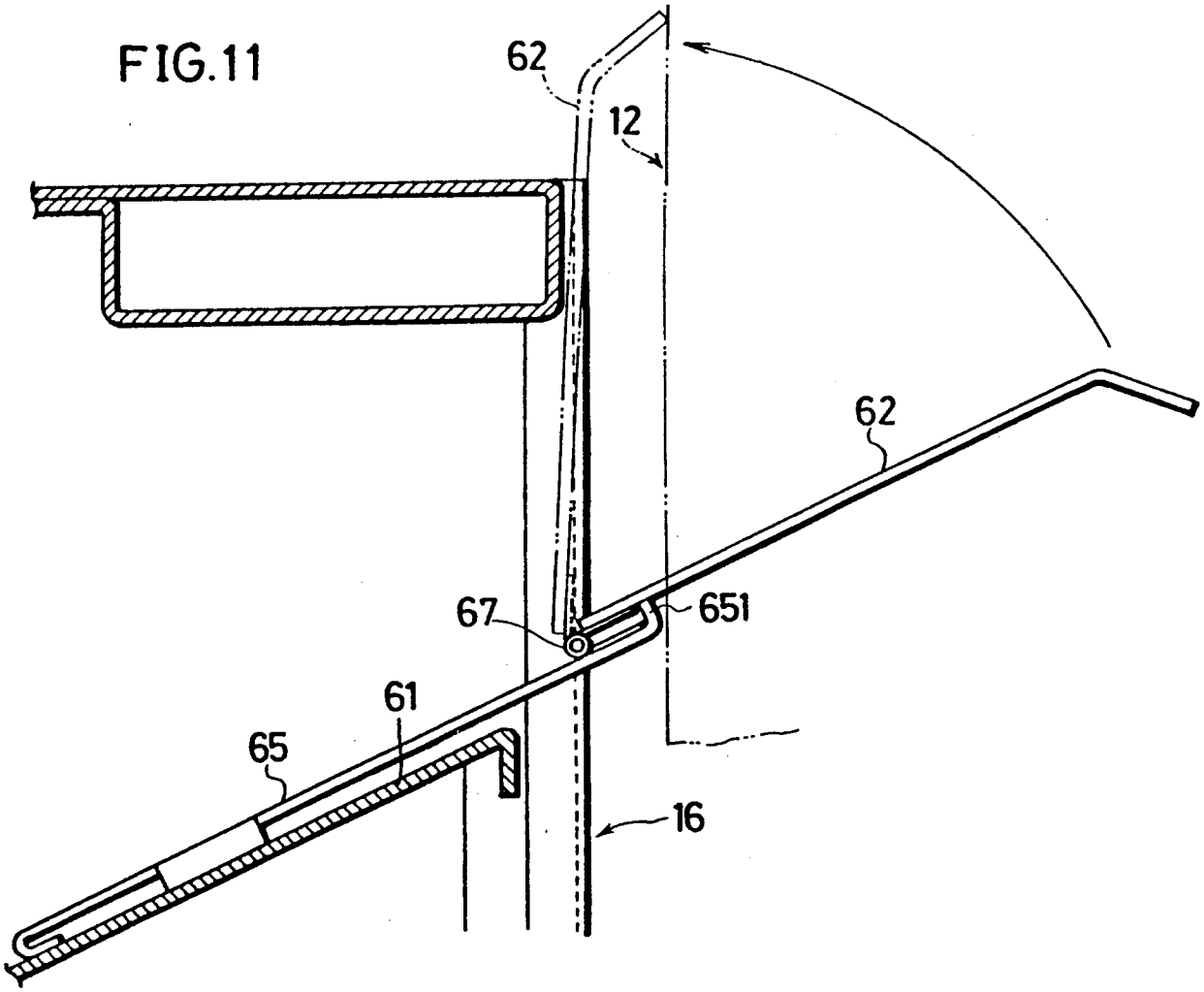
FIG. 11 is a side elevation partly broken away and showing a mount structure for a copy paper guide member in the image forming apparatus.

With reference to FIG. 11, the support plate 65 is secured to the inlet portion of stacking tray 61, extends along the tray 61 and is provided at its front end with a restraining portion 651 projecting upward. With a hinge 67, the guide plate 62 is connected at its base end to the support plate 65 at an inside portion thereof close to the restraining portion 651 (at the left side portion in FIG. 11). Consequently, the paper guide plate 62 is forwardly unfoldable away from the front wall of the stacking frame 16, and is pivotally movable between a guide position (solid-line position in FIG. 11) in which the guide plate 62 is held projected forward by the bearing contact of the lower surface of the plate 62 with the restraining portion 651 and a retracted position (phantom-line position in FIG. 11) in which the plate 62 extends along the front wall. The copy paper delivered from the pair of discharge rollers 40 of the copying assembly 14 of FIG. 1 is guided onto the stacking tray 61 by the guide plate 62 when the plate is in the guide position.

A copy paper holder 63 of polyester film or the like is provided above the stacking tray 61.

The roll paper cutting device 12 is attached to the front side wall of the stacking frame 16 and is movable upward and downward. The mount structure and drive system for the device 12 will be described with reference to FIGS. 3 to 6.

A pair of guide rails 64 open inward are secured to the opposite sides of the front wall of the copy paper stacking frame 16. The guide rails 64 extend from the lower end of the stacking frame 16 to the lower end of the unit housing 60 of the copying assembly 14. Within the range of length of the rails, the roll paper cutting device 12 is movable upward and downward (see the solid-line and phantom-line positions of the device 12 in FIG. 1).

On the other hand, the cutting device 12 rotatably carries shafts 68, 69 extending through opposite inner side plates 66 (FIGS. 4 to 6) thereof. Rollers 71, 72 loosely fitted in the guide rails 64 are fixed to opposite ends of these shafts 68, 69.

Figure 3:
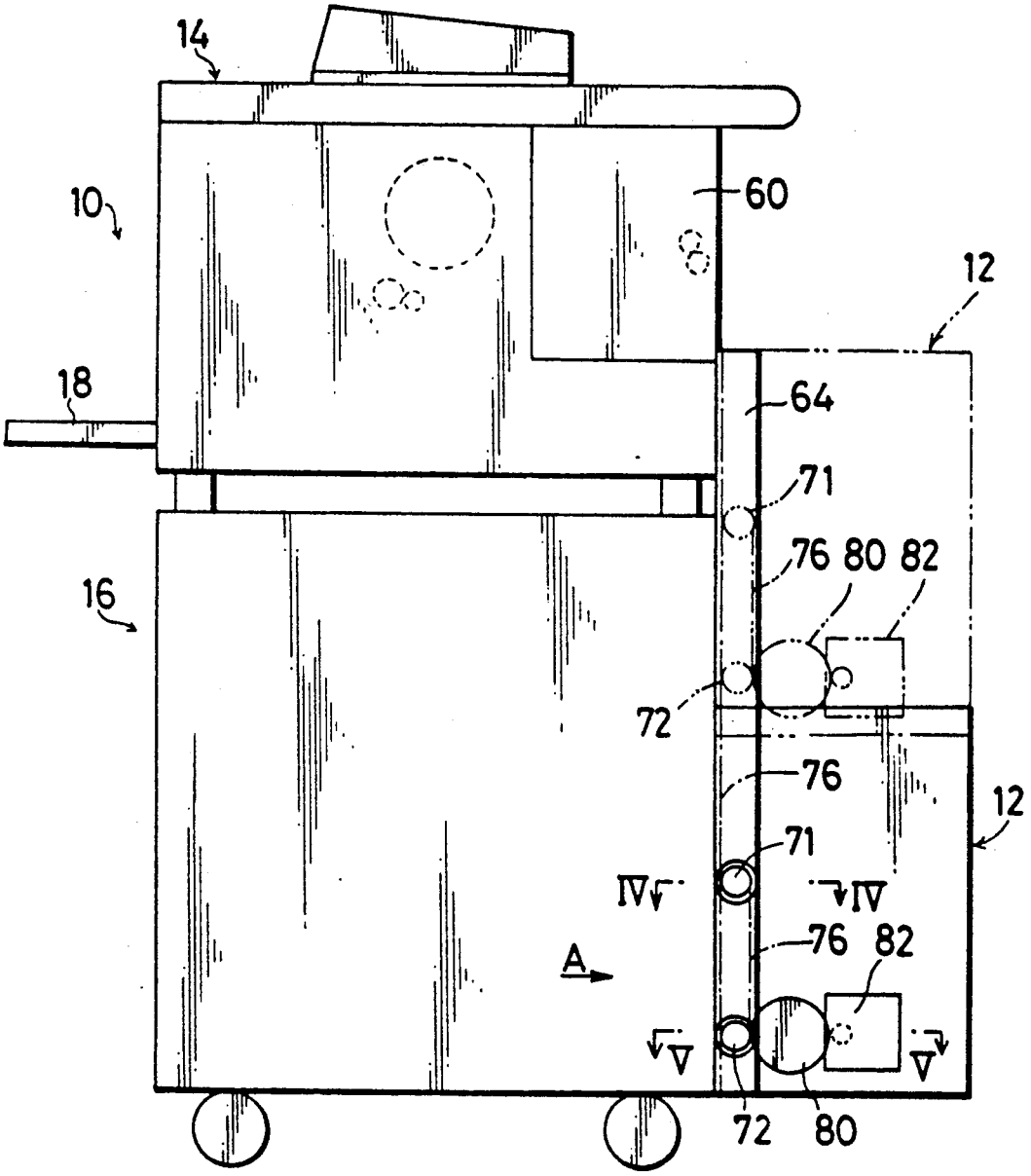
FIG. 3 is an overall diagram showing a drive system for a roll paper cutting device in the image forming apparatus.
Figure 4:
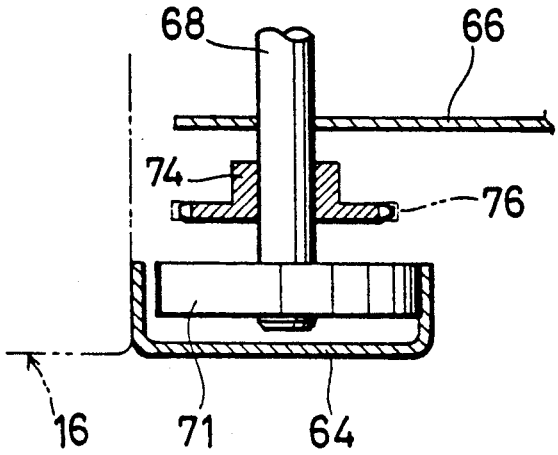
FIG. 4 is a view in section taken along the line IV—IV in FIG. 3.
Figure 6:
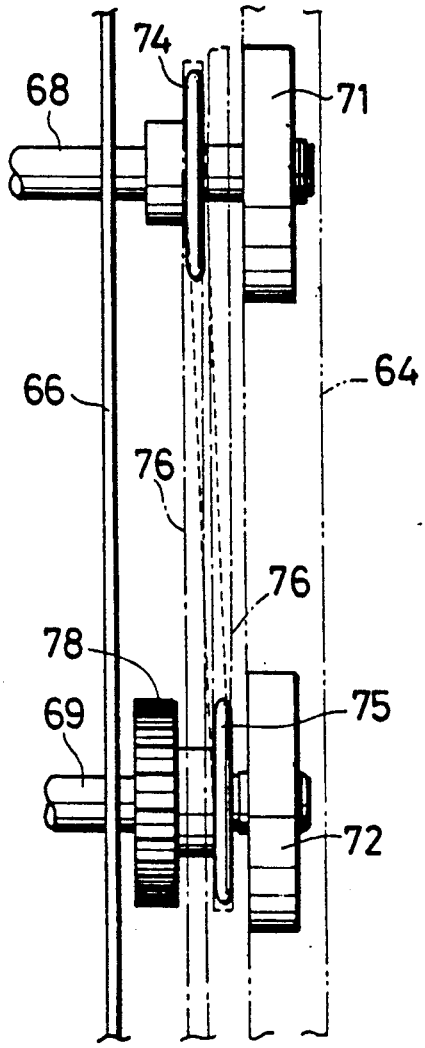
FIG. 6 is a fragmentary view of the drive system as it is seen in the direction of arrow A in FIG. 3.

Inwardly of the rollers 71, 72 immediately adjacent thereto, sprockets 74, 75 are secured to the respective shafts 68, 69. At the respective sides of the cutting device, identical chains 76 are looped around the sprockets 74, 75 as seen in FIGS. 3 and 6. The upper and lower ends of these chains 76 are secured to the upper and lower ends of the respective guide rails 64.

Figure 5:
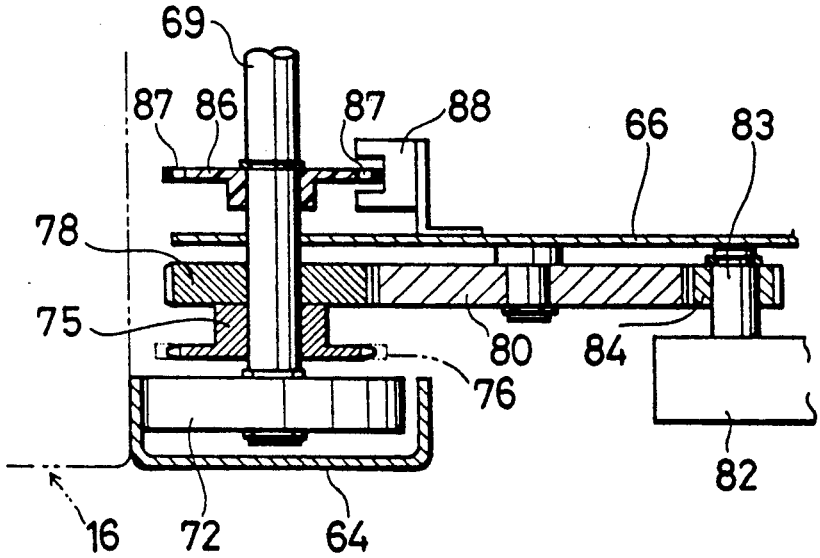
FIG. 5 is a view in section taken along the line V—V in FIG. 3.

As seen in FIG. 5, a gear 78 is fixed to one end (closer to the plane of FIG. 3) of the shaft 69 and is in mesh with an idle gear 80 which is rotatably supported by the inner side plate 66. A drive motor 82 fixed by an unillustrated bracket to the outer side of the inner side plate 66 has a drive shaft 83 which fixedly carries a gear 84 meshing with the idle gear 80. Thus, the cutting device 12 is supported at a specified level by the guide rails 64 with which the rollers 71, 72 are in contact, and the chains 76 which are reeved around the sprockets 74, 75. Further the rotation of the drive motor 82 carried by the device 12 itself is transmitted via the gears 84, idle gear 80 and gear 78 to the shaft 69, which in turn rotates the sprockets 75 fixed to the shaft 69 and in engagement with the respective chains 76, whereby the entire device 12 is driven upward or downward along the guide rails 64.

Figure 7:
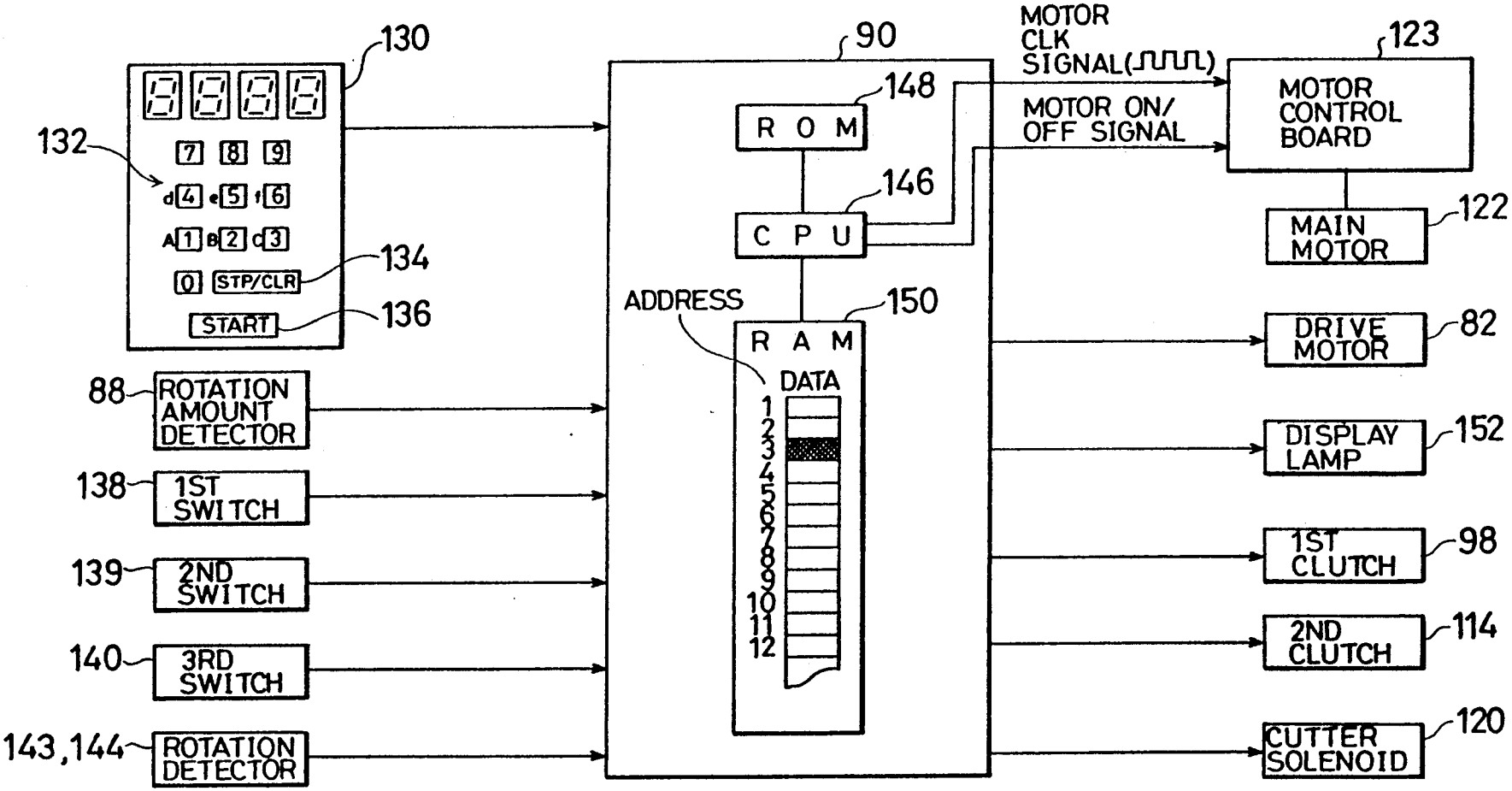
FIG. 7 is a block diagram showing the input-output relationship of a control system included in the roll paper cutting device.

The shaft 69 fixedly carries a pulse plate 86 as seen in FIG. 5. The device 12 further has means 88 for detecting the amount of rotation (amount of shift) comprising a photosensor including a light-emitting member and a photodetector which are positioned on opposite sides of a slit 87 formed in the pulse plate 86. The cutting device 12 further has incorporated therein a control system (control means) 90 comprising a microcomputer as seen in FIG. 7. The rotation amount detector 88 feeds a detection signal to the control system 90.

The roll paper cutting device 12 further has at its upper portion a copy paper discharge tray 99 (see FIG. 1) which is open obliquely upward. With the device 12 in its upper limit position (solid-line position in FIG. 1), the copy paper delivered from the pair of discharge rollers 40 is accumulated on the discharge tray 99.

The interior structure of the cutting device 12 will be described next with reference to FIG. 8.

The roll paper cutting device 12 is internally provided with a roll shaft 93 for roll paper 92 upwardly and downwardly movably along a slot 94 formed in each side wall of the device. The device also has at its lower portion a pair of rotatable transport rollers 95, 96. The roll shaft 93 is biased downward by an unillustrated spring, whereby the roll paper 92 is pressed downward at all times in its entirety, with the periphery thereof held in contact with the transport rollers 95, 96 regardless of the diameter of the roll. The transport roller 95 is coupled by unillustrated gears to the driven side of a first clutch 98 which is shown also in FIG. 7.

A cover 100 is openably attached to the front side (right side in FIG. 8) of the device. When opened (to the phantom-line position of FIG. 8), the cover 100 permits the user to manually set the roll paper 92 in position.

Arranged above the roll paper 92 along a direction upward therefrom are a holding roller 102 (shown only in FIG. 1), a pair of feed rollers 103, 104, a pair of cutters 105, 106 and a pair of discharge rollers 108, 109. An outlet 110 for the roll paper 92 is provided above the discharge rollers.

One of the feed rollers 103, 104, i.e., the feed roller 103 is coupled by gears 111, 112 to the driven side of a second clutch 114 which is shown also in FIG. 7. The other feed roller 104 is rotatably attached to a pivotal bracket 118 by a plate spring 116 and is usually held in pressing contact with the feed roller 103 by being biased with the plate spring 116. With the cover 100 in its opened state, the roller 104 can be moved out of contact with the roller 103 by pivotally moving the bracket 118 in the direction of arrow B in FIG. 8.

The cutter 105 is in the form of a circle partly cut away along a straight line and is connected to a cutter solenoid 120 shown in FIG. 7. The cutter 105 is rotated by the energization of the solenoid 120. The other cutter 106 is positioned as opposed to the cutter 105 with a paid-off portion of the roll paper 92 interposed therebetween. During the rotation of the cutter 105, an edge at the intersection of a plane thereof with a cylindrical surface providing the outer periphery of the cutter 105 comes into frictional contact with an edge of the other cutter 106, whereby the roll paper 92 is cut.

The pair of discharge rollers 108, 109 are in pressing contact with each other. The discharge roller 108 at one side is coupled to the feed roller 103 by a train of unillustrated gears and is driven with the feed roller 103.

The cutting device 12 has a main motor 122 incorporated therein and serving as a drive source for the foregoing rollers. The main motor 122 is connected to a motor control board 123 (FIG. 7). A drive roller 124 is fixed to the drive shaft of the main motor 122. A single belt 126 is reeved around the drive roller 124 and the drive-side portions of the first clutch 98 and the second clutch 114.

Accordingly, when the first clutch 98 is engaged, the transport roller 95 in an idly rotatable state is brought into a driven state, and the torque of the drive roller 124 is delivered to the feed roller 103. When the second clutch 114 is engaged, the feed roller 103 in an idly rotatable state is brought into a driven state, and the torque of the drive roller 124 is transmitted to the feed roller 103. According to the present embodiment, the gear ratios concerned are so determined that the feed roller 103 is driven at twice the speed of rotation of the transport roller 95.

Figure 8:
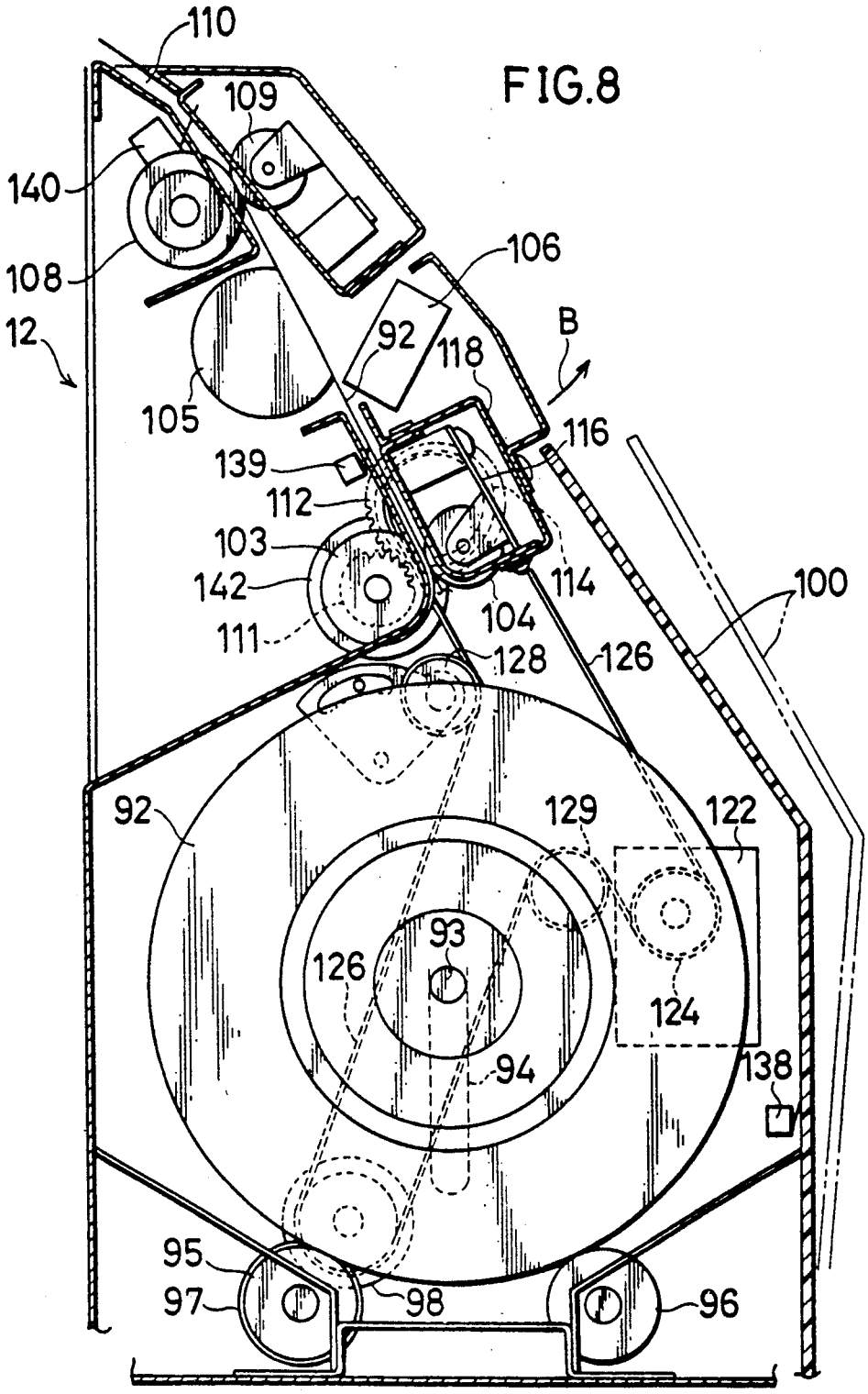
FIG. 8 is a view showing the interior construction of the roll paper cutting device.

Indicated at 128 and 129 in FIG. 8 are tension rollers for the belt 126.

On an external suitable portion of the roll paper cutting device 12, a control panel 130 as shown in FIG. 7 is provided The control panel 130 has ten number entry keys 132, a stop/clear key 134 and a start key 136 as illustrated, and is further provided with a key for selecting a paper feed mode (cassette feed mode or manual insertion mode), a size specifying key for entering the size of sheets to be cut off from the roll paper, a shift start key for starting the shift of the cutting device 12, etc. Using some of the number entry keys 132 on the control panel 130, the desired roll paper transport speed can be set and input to the control system 90 as will be described later.

As shown also in FIG. 8, the device has inside thereof a first switch 138 so positioned as to contact the cover 100 when the cover 100 is closed, and second and third switches 139 and 140 arranged upstream from the cutters 105, 106 and downstream from the discharge rollers 108, 109, respectively. The switches 139, 140 are turned on and off by the roll paper 92 when the paper passes the position of the switch. Pulse plates 97, 142 are secured to the respective shafts fixedly carrying the transport roller 95 and the feed roller 103. Rotation detectors 143, 144 (FIG. 7), each comprising a light-emitting element and a photodetector, are positioned in corresponding relation with slits in the respective pulse plates 97, 142. These rotation detectors 143, 144 and the switches 138 to 140 feed detection signals to the control system 90.

The control system 90 comprises a CPU 146, ROM 148 and RAM 150 and carries out the following control operations mainly.

(a) Based on a signal representing the transport speed input according to hexadecimal notation by some number entry keys 132 on the control panel 130, the CPU 146 writes data as to the transport speed in the RAM 150 and feeds to the motor control board 123 a motor clock signal corresponding to the data to control the speed of rotation of the main motor 122. More specifically, the speed of the motor is controllable by varying the frequency or duty ratio of the motor clock signal. The gear ratio or the like of the drive system within the cutting device 12 is made equal to the gear ratio or the like of the drive system in the main body of the copying machine, 10. When data as to a speed equal to the speed of transport of copy paper in the machine body 10 is entered by the number entry keys 132, the speed of transport by the transport roller 95 is made equal to the transport speed in the main body 10.

(b) The drive motor 82 is started upon the depression of the shift start key on the control panel 130 and stops the drive motor 82 upon the rotation amount detector 88 detecting a predetermined number of pulses after the start of the motor 82. The predetermined pulse number corresponds to the distance from the upper limit position (feed position indicated in solid line in FIG. 1) of the cutting device 12 to the lower limit position (standby position indicated in phantom line in FIG. 1) thereof. The upper limit position is such that in this position, the outlet 110 of the device 12 is in register with the copy paper inlet 28 of the copying assembly 14.

(c) In response to the detection signals from the first switch 138, the third switch 140 and the rotation detector 144, the control system feeds motor on and off signals and motor clock signal to the motor control board 123, and turns on and off the clutches 98, 114 and the cutter solenoid 120 with specified timing. The timing will be described in detail later with reference to the flow charts of FIGS. 9 and 10.

(d) When the second switch 139 is turned on, a display lamp 152 provided in the vicinity of the control panel 130 is turned on, notifying the user that the roll paper 92 is set in position.

Figure 9:
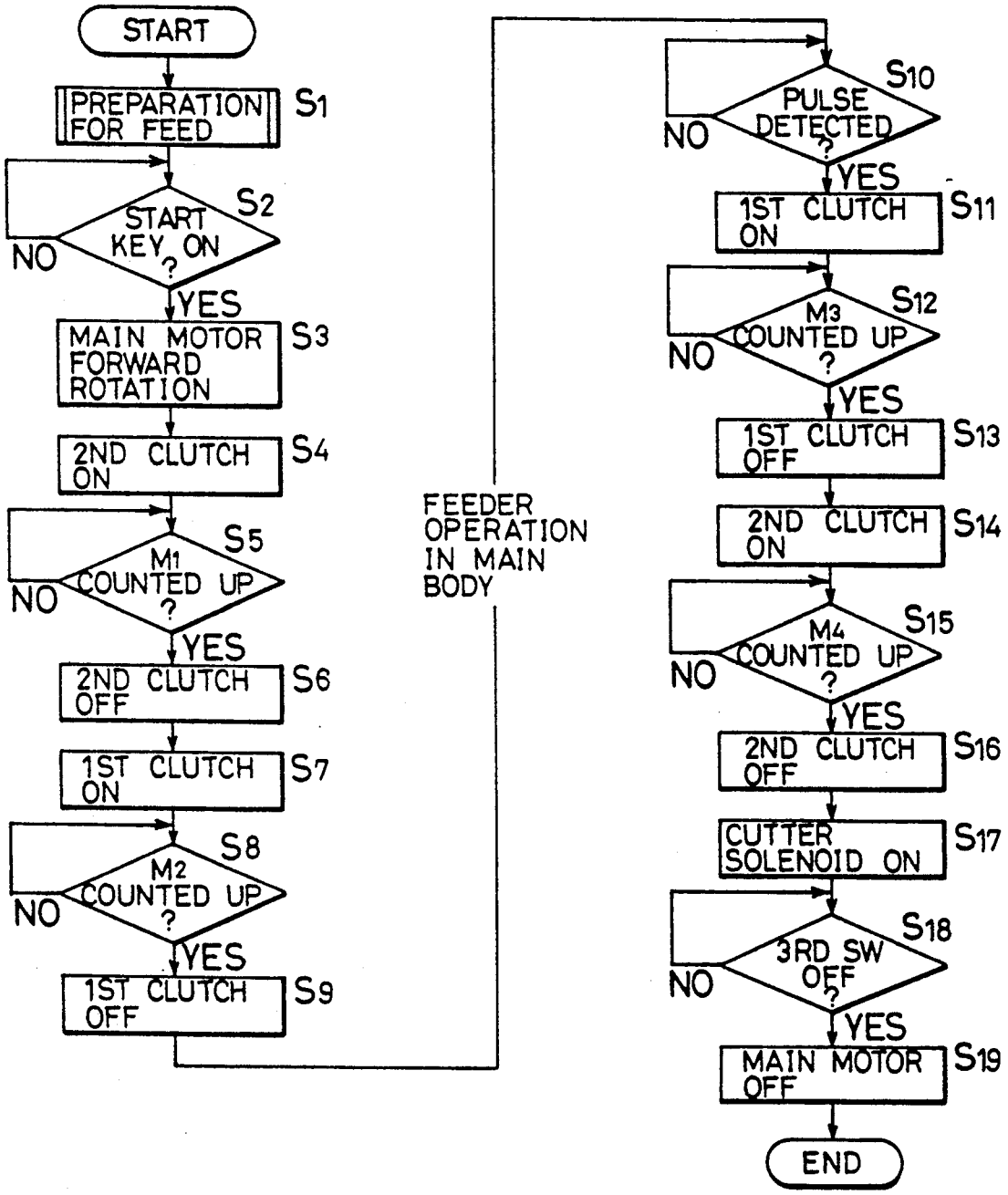
FIGS. 9 and 10 are flow charts showing the control operation to be performed by the control system of the cutting device.
Figure 10:
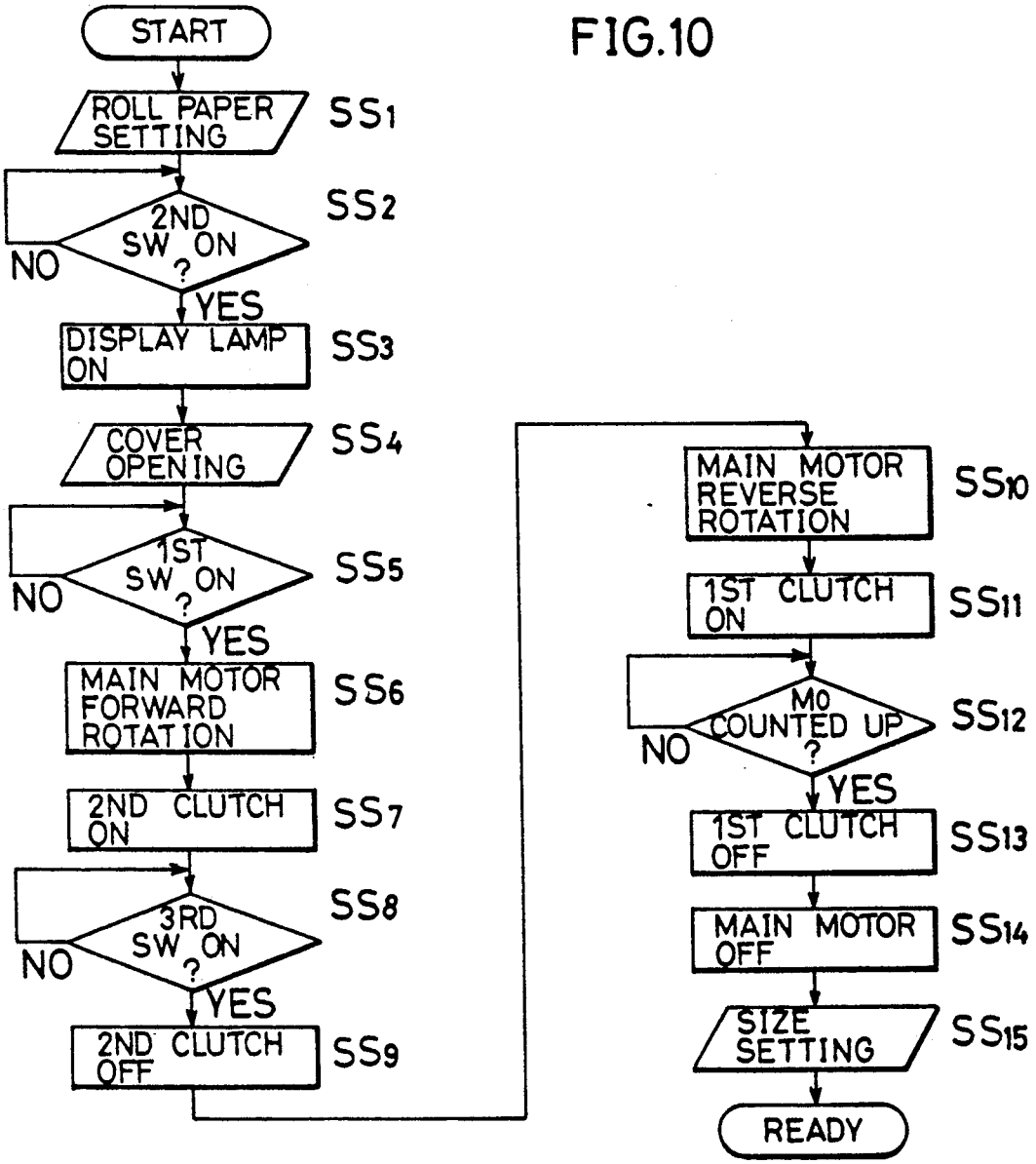

Next with reference to the flow charts of FIGS. 9 and 10, a description will be given of the control operation to be actually performed by the control system 90 and the resulting paper feed operation by the device. FIG. 9 shows the operation for feeding the roll paper 92, and FIG. 10 shows a preparatory operation before the start of the feed operation (i.e., step S1 of FIG. 9).

First, the copying machine main body 10 is set in the manual insertion mode, in which copy paper is fed from the copy paper inlet 28. The roll paper cutting device 12 is allowed to stand as it is if the device is in its upper limit position where the outlet 110 of the device 12 is in register with the inlet 28. If the device 12 is in its lower limit position, the shift start key on the operation panel 130 is depressed, whereby the device 12 is driven upward in its entirety by the drive motor 82, allowing the rotation amount detector 88 to produce a pulse signal. When the predetermined number of pulses are counted up, the motor 82 is deenergized, whereby the device 12 is automatically brought to a halt at the upper limit position, i.e., at the feed position.

On the other hand, when the device 12 is in its standby position away from the position where the copy paper guide plate 62 is attached, the guide plate 62, which is unfolded outward under gravity, is in the guide position where the lower surface of the guide plate 62 is in bearing contact with the restraining portion 651 of the support plate 65 as seen in FIG. 11. Accordingly, the copy paper discharged from the copying assembly 14 falls onto the guide plate 62 and is guided by the plate 62 to a specified position on the stacking tray 61.

When the cutting device 12 moves upward from the standby position to the feed position, the guide plate 62 is pushed up from below by the device 12 and automatically folded from the guide position (phantom-line position in FIG. 1) to the retracted position indicated in solid line in FIG. 1.

With the cutting device 12 thus brought to the upper limit position, some of the number entry keys 132 on the operation panel 130 of the device 12 are manipulated to input data as to the roll paper cutting size and roll paper transport speed to the control system 90. The data as to the transport speed is the same as the data representing the copy paper transport speed of the copying machine main body 10.

In this state, the preparatory operation for paper feeding shown in FIG. 10 is conducted. First, the cover 100 of the cutting device 12 is opened, and the pivotal bracket 118 is moved in the direction of arrow B in FIG. 8 to move the feed roller 104 out of pressing contact with the feed roller 103, and the leading end of the roll paper 92 wound around the roll shaft 93 is manually inserted through a space between, the feed rollers 103, 104 (step SS1). The leading end is brought to the position of the second switch 139, turning on the switch 139 (YES for step SS2), whereupon the display lamp 152 of the device 12 goes on (step SS3). The operator then discontinues the roll paper setting procedure, and returns the pivotal bracket 118 to bring the roller 104 into contact with the roller 103.

The cover 100 is thereafter closed (step SS4), whereby the first switch 138 is turned on (YES in step SS5), feeding a detection signal to the control system 90, whereupon the system 90 feeds a control signal to the motor control board 123 to rotate the main motor 122 in the forward direction and drive the drive roller 124 clockwise in FIG. 8 (step SS6). The second clutch 114 is further engaged (step SS7). Consequently, the feed roller 103 and the discharge roller 108 are driven counterclockwise in FIG. 8, pulling out the roll paper 92 in the feed direction. At this time, the main motor 122 is driven at a transport speed lower than the speed input by the number entry keys 132.

The roll paper 92 thereafter passes between the discharge rollers 108, 109 and reaches the third switch 140 to turn on the switch 140 (YES in step SS8), whereupon the resulting detection signal is fed to the control system 90, which in turn disengages the second clutch 114 (step SS9). This discontinues the transport of the roll paper 92.

Subsequently, the control system 90 reversely rotates the main motor 122 to drive the drive roller 124 in a direction opposite to the above (step SS10), and further engages the first clutch 98 (step SS11), whereby the transport roller 95 is rotated clockwise in FIG. 8 to draw back the roll paper 92 downward.

At this time, the pulse plate 97 rotating with the transport roller 95 and the rotation detector 143 feed to the control system 90 data as to the rotation of the transport roller 95 as a pulse signal. Upon the number of pulses of this signal reaching a predetermined pulse number M0 (YES in step SS12), the control system 90 disengages the first clutch 98 (step SS13) and deenergizes the main motor 122 (step SS14). The pulse number M0 is so determined as to correspond to the distance of the position of cutting by the cutters 105, 106 from the detection position of the third switch 140, so that the operation of steps SS10 to SS14 stops the leading end of the roll paper 92 accurately at the position where the paper is to be cut by the cutters 105, 106.

Some of the number entry keys 132 are thereafter manipulated on the control panel 130 to enter a pulse number M corresponding to the desired size to which the roll paper is to be cut (step SS15), whereby the preparation for feeding is completed.

The subsequent paper feed operation to be performed by the device 12 will be described with reference to the flow chart of FIG. 9.

After the completion of preparation (step S1) described above, the start key 136 on the control panel 130 shown in FIG. 7 is depressed (step S2), causing the control system 90 to feed a motor on-off signal and motor clock signal to the motor control board 123 to forwardly drive the main motor 122 at a high speed (step S3). The term "high speed" as used herein corresponds to the roll paper transport speed entered by the number entry keys 132, and the motor clock signal corresponding to this speed is fed to the control board 123. If the first clutch 98 is engaged, the above signals cause the transport roller 95 to rotate at a speed equal to the copy paper transport speed of the copying assembly, or if the second clutch 114 is engaged, the feed roller 103 is rotated at twice the speed of the transport roller 95.

In the above state, the control system 90 first engages the second clutch 114 (step S4), whereby the feed roller 103 is driven counterclockwise in FIG. 8, delivering the roll paper 92 from the outlet 110 into the inlet 28 of the copying assembly 14.

At this time, the rotation of the feed roller 103 is detected by the pulse plate 142 and the rotation detector 144. Upon the pulse number of the detection signal reaching a predetermined pulse number M1 (YES in step S5), the second clutch 114 is disengaged (step S6) to discontinue the transport of the roll paper 92. The pulse number M1 corresponds to the distance of the pair of feed rollers 22 from the cutting position of the cutters 105, 106, so that the operation of steps S4 to S6 brings the leading end of the paper 92 to the position of the pair of feed rollers 22 of the copying assembly 14.

Next, the control system 90 engages the first clutch 98 (step S7), thereby driving the transport roller 95. The rotation is detected by the rotation detector 143. Upon the pulse number of the detection signal reaching a predetermined pulse number M2 (YES in step S8), the first clutch 98 is disengaged (step S9) to stop the rotation of the roller 95. The operation of steps S7 to S9 rotates the transport roller 95 only, warping the paper at its portion upstream from the feed rollers 103, 104. The rollers are now in an idly rotatable state, ready for the start of feed of paper for the machine main body 10.

The feed rollers 22 in the machine body 10 thereafter operate, starting to feed the roll paper 92, whereby the portion of the roll paper 92 within the device 12 is pulled upward and rotates the feed roller 103 by contact therewith.

When this rotation is detected by the rotation detector 144 (YES in step S10), the control system 90 engages the first clutch 98 (step S11) to rotate the transport roller 95. Upon the pulse number of the detection signal 144 from the detector 144 reaching a predetermined pulse number M3 (YES in step S12), the first clutch 98 is disengaged (step S13). The pulse number M3 is the pulse number corresponding to the size of sheet to be cut off from the roll paper 92 and set on the operation panel 130, minus a number of pulse, m, that is, M−m. Accordingly, the operation of steps S11 to S13 transports the roll paper 92 within the device 12 a distance corresponding to the pulse number M3, i.e., M−mm, at a speed equal to the feed speed in the machine body 10.

Subsequently, the control system 90 engages the second clutch 114 (step S14), rotating the feed roller 103, and disengages the second clutch 114 (step S16) upon the pulse number of the detection signal from the rotation detector 144 reaching a predetermined pulse number M4 (YES in step S15). The pulse number M4 is the value m. Accordingly, the operation of steps S14 to S16 transports the roll paper 92 within the cutting device 12 a distance corresponding to the pulse number M4 (=m) at twice the feed speed in the machine main body 10. Consequently, the roll paper 92 is transported forward excessively by a distance corresponding to one-half of the pulse number m, forming a warped portion upstream from the cutters 105, 106 so as to be cut with proper timing.

Next, the control system 90 energizes the cutter solenoid 120 only for a predetermined period of time (step S17) to rotate the cutter 105 one turn and cut the roll paper 92. The rear end of the cut sheet of the roll paper 92 thereafter moves past the third switch 140 and turns off the switch 140 (YES in step S18), whereupon the system deenergizes the main motor 122 (step S19) to complete the feed operation.

While the roll paper 92 is fed by the above operation using the cutting device 12, paper may be fed manually to the machine main body 10 through the copy paper inlet 28 without using the cutting device 12. In this case, the shift start key on the operation panel of the device 12 is manipulated to lower the device 12 to its lower limit position, whereby the inlet 28 is exposed at the front side of the machine body 10 and made ready for use. Paper can then be manually inserted into the inlet 28.

According to the present embodiment described, the roll paper cutting device 12 is attached to the copying machine main body 10 so as to be vertically movable between the upper limit position in which the outlet 110 of the device 12 is in register with the copy paper inlet 28 and the lower limit position in which the outlet 110 is away from the inlet 28. The roll paper 92 can be fed by the device 12 as positioned in the upper limit position to the machine main body 10 which is an existing copying machine. With the device 12 shifted from the upper limit position to the lower limit position, paper can be fed in the conventional manner utilizing the manual insertion feed mechanism usually incorporated in the main body 10 of the image forming apparatus.

Further according to the present embodiment, the copy paper guide plate 62 is shiftable between the guide position and the retracted position with the vertical movement of the cutting device 12, such that even if the guide plate 62 is located at the feed position for the cutting device 12, the device 12 can be driven vertically free of trouble.

The roll paper cutting device 12 of the present embodiment has the following advantages.

(a) The cutting device 12 has the rotation amount detector 88 for detecting the amount of shift of itself and the control system 90 and therefore has the advantage of being automatically movable singly to an appropriate position without being controlled by the copying machine main body 10. Further because the device 12 can be driven and is operable for feed paper without conducting signal communication with the machine main body 10, the device 12 has improved optionality for use with the machine main body 10. However, the device 12 can be made satisfactorily movable up and down by drive means provided in the machine main body 10.

(b) The cutting device 12 can be set to a desired roll paper transport speed by feeding data as to the speed to the control system 90 by means of the control panel 130, so that when the speed is determined in accordance with the copy paper transport speed in the machine main body 10 to which the device is attached, the roll paper within the device 12 can be transported to the interior of the main body 10 at a stabilized speed. Thus, the device 12 is usable for the machine main body 10 at widely varying copy paper transport speeds for supplying the roll paper to the machine body 10 free of trouble.

With the foregoing embodiment, the transport roller 95 is driven at the same speed as the set speed, and the feed roller 103 is driven at twice the set speed, whereas the relationship between the speed set by the transport speed input means and the speed of transport of the roll paper by the transport rollers may be determined suitably according to the structure used.

(c) With the roll paper cutting device 12, the roll paper 12 set in place is first transported to a position downstream from the cutters 105, 106 and then reversely transported by a distance corresponding to the predetermined pulse number M0 upon the leading end of the paper reaching the delivery position of the third switch 140. Accordingly, the leading end of the roll paper 92 can be brought to the cutting position more accurately than conventional devices wherein the paper leading end is brought to the specified position manually. The reverse transport serves to eliminate the warped portion of the paper between the roll portion of the paper 12 and the feed rollers 103, 104. This leads to the advantage of reducing the load on the drive system when starting the feeding operation.

The paper leading end can be positioned in place by the following modifications.

(1) Although the cutting device 12 is attached to the machine main body 10 vertically movably according to the foregoing embodiment, the cutting device 12 may be used independently of the machine body 10 for cutting the roll paper 92 for the machine body 10 to use the cut sheets. Even in this case, the same advantage of automatic leading end positioning as above is available. The cut sheets of roll paper 92 are of course not limited to use for copying machines.

(2) The leading end of the roll paper 92 is positioned at the cutting position of the cutters 105, 106 according to the foregoing embodiment, whereas this position is not limitative but may be determined suitably. However, if the leading end is placed at the cutting position, the roll paper can be cut into sheets of the same size under the same mode of control from the first sheet. This simplifies the mode of control to be effected by the control system 90.

(3) The third switch serving as roll paper sensor means is disposed downstream from the discharge rollers 108, 109 with the above embodiment, whereas the roll paper sensor means needs only to be positioned downstream from the cutting position of the cutters. For example, the sensor means may be interposed between the cutters 105, 106 and the discharge roller 108, 109.

(4) Although the roll paper 92 is positioned in place based on the amount of rotation of the feed roller 103 with the above embodiment, the same advantage as above is also available when the transport of the paper is discontinued upon the lapse of a predetermined period of time after the actuation of the third switch 140.

The mount structure for the copy paper guide member of the invention is not limited to the one described above but may be the one shown in FIGS. 12 and 13 as a second embodiment.

With reference to these drawings, a pair of opposite guide members 160 are fixed to the upper side of the copy paper stacking tray 61 at its inlet portion. A copy paper guide plate (copy paper guide member) 62 is provided between the two guide members 160 so as to be slidable between a guide position where the guide plate 62 projects from the stacking frame 16 and a retracted position in which the plate 62 is stowed inside the frame 16.

A rack 162 extending in the sliding direction is secured to the lower surface of the guide plate 62 and exposed downward through a groove 164 formed in the lower side of the stacking tray 61. A gear 166 in mesh with the rack 162 is rotatably provided within the stacking frame 16, which is also rotatably provided with a gear 168 as partly exposed from the frame 16. The two gears 166 and 168 are coupled together by a belt 170.

Figure 12:
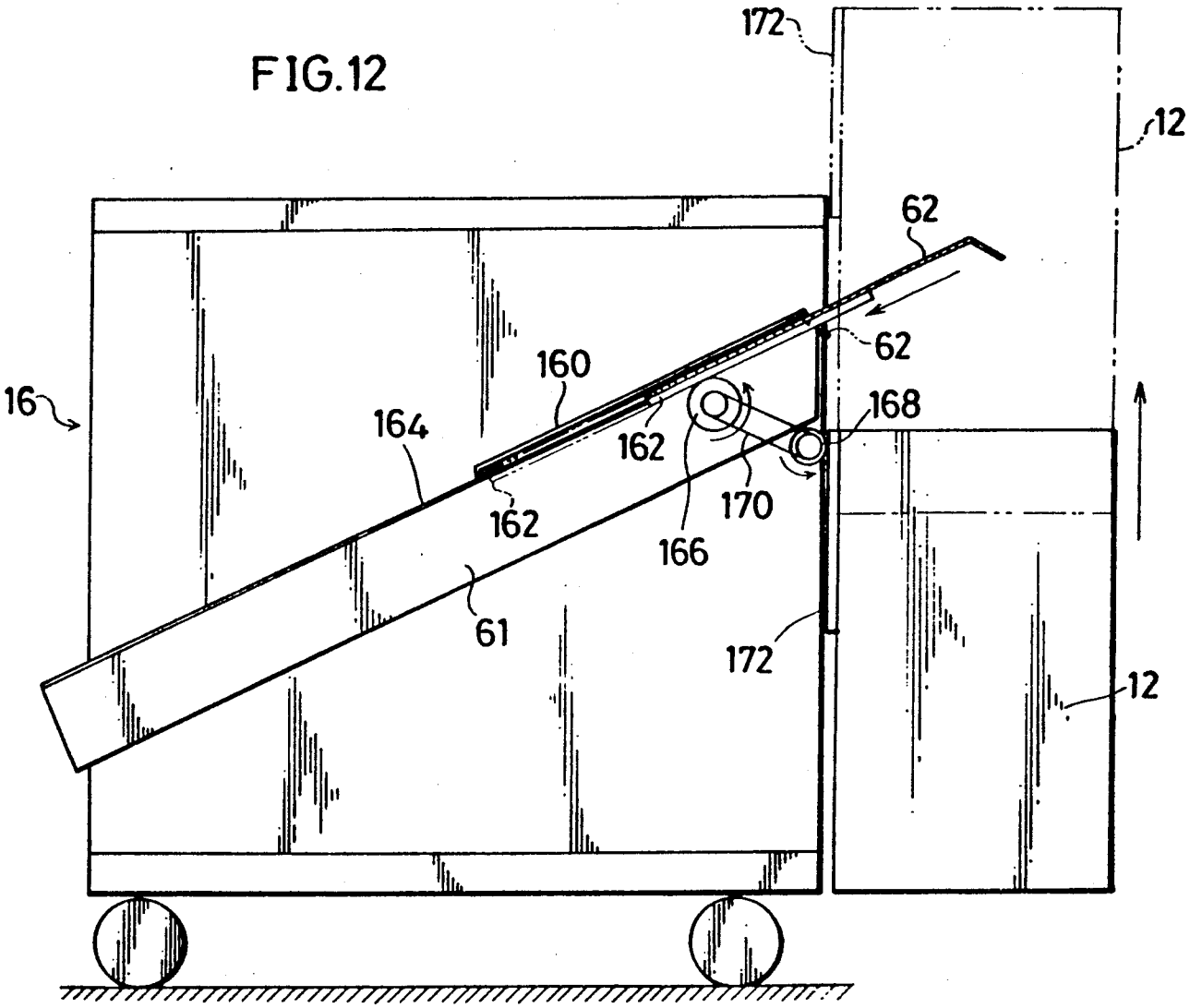
FIG. 12 is a side elevation partly broken away and showing a mount structure for a copy paper guide member included in another image forming apparatus as a second embodiment.
Figure 13:
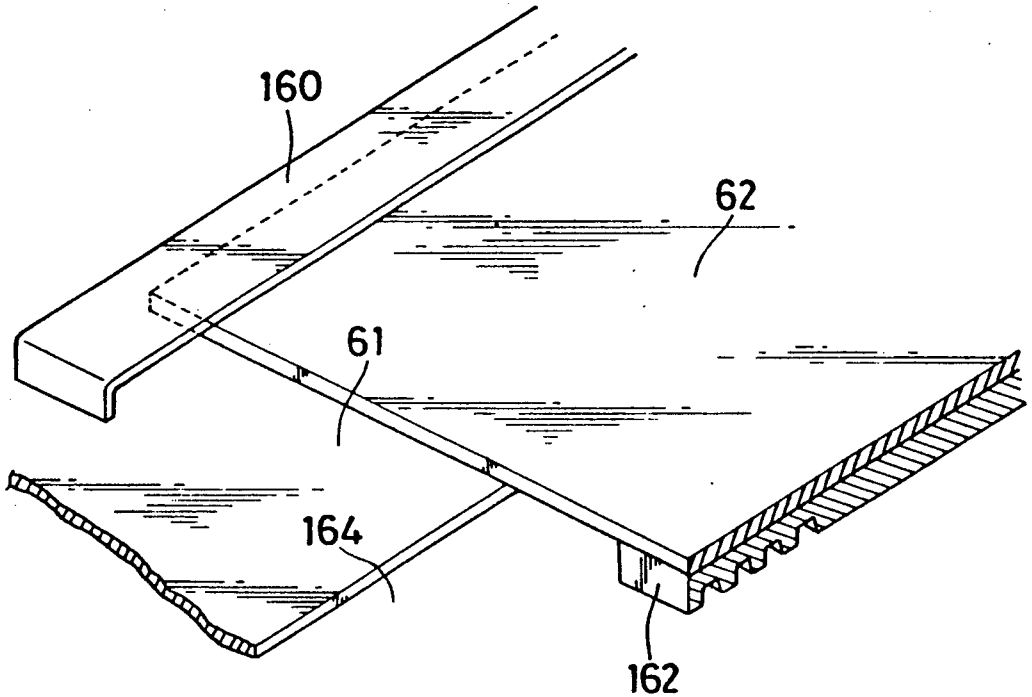
FIG. 13 is a perspective view partly broken away and showing the mount structure.

On the other hand, the cutting device 12 has a rack 172 extending vertically and attached to the upper portion of the side face thereof opposed to the stacking frame 16. The rack 172 is meshable with the gear 168. As shown in FIG. 12, the position of the guide plate 62 is so determined that when the gear 168 is in mesh with the upper end of the rack 172, the gear 166 meshes with the base end of the rack 162 (left end thereof in FIG. 12).

When the cutting device 12 is in its standby position with the gear 168 meshing with the upper end of the rack 172 on the device 12 as indicated in solid line in FIG. 12, the guide plate 62 is projected out from the stocking frame 16 for guiding the discharged copy paper onto the stacking tray 61.

When the cutting device 12 moves upward from the above state, the upward movement of the rack 172 on the device 12 is converted to sliding movement of the guide plate 62 by means of the gear 168, belt 170, gear 166 and rack 162, whereby the guide plate 62 is brought to the retracted position as stowed in the stocking frame 16 (see the phantom-line position in FIG. 12). Accordingly, the guide plate 62 will not interfere with the device 12 when the device moves upward, permitting smooth shift of the device 12 to the feed position.

Alternatively, the guide plate 12 may be driven by a motor or the like provided therefor, as controlled by the shift of the cutting device 12.

Figure 14:
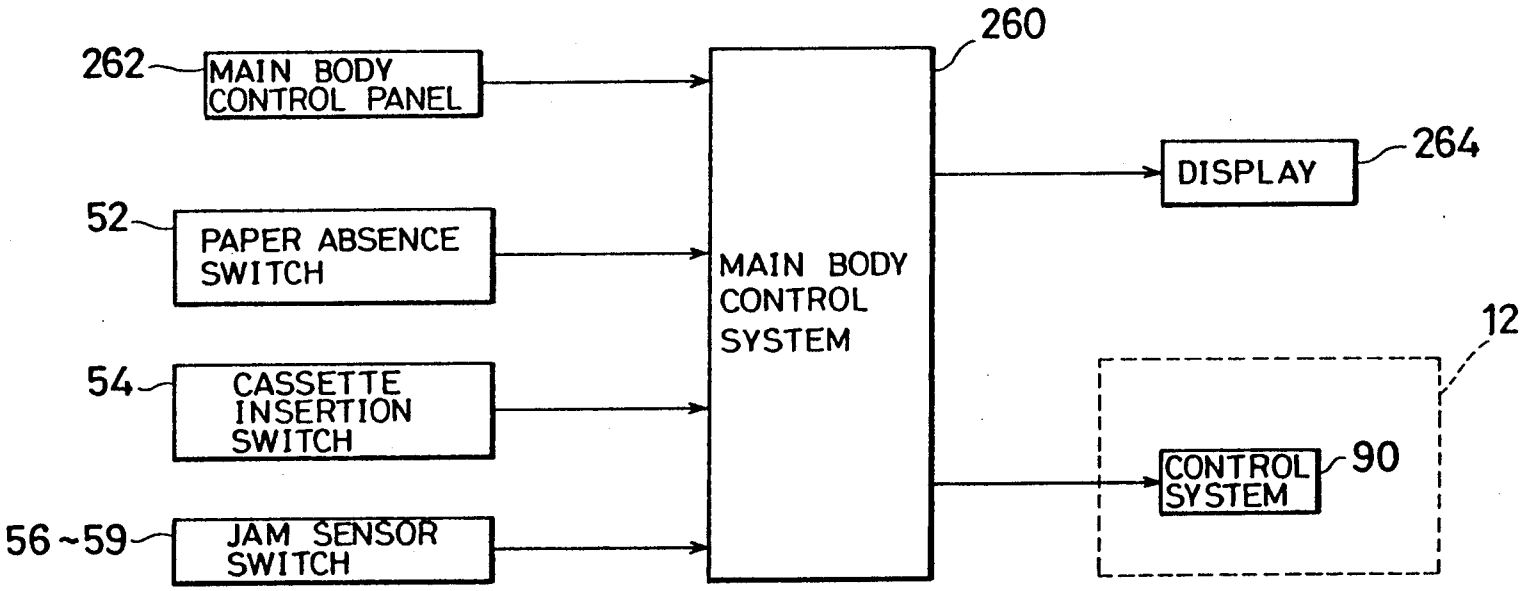
FIG. 14 is a block diagram showing the main components of another image forming apparatus as a third embodiment.

Next, a third embodiment will be described with reference to FIG. 14.

With the foregoing embodiments, the cutting device 12 is driven singly by itself independently of the machine main body 10, whereas according to the third embodiment, the control system 260 incorporated in the copying machine main body 10 is utilized for controlling the device 12 for driving. The machine main body 10 has a control panel 262 which is adapted to select a roll paper feed mode in addition to the manual insertion mode and cassette feed mode.

The main body control system 260 receives instruction signals from the control panel 262 and detection signals from the aforementioned paper absence switch 52, cassette insertion switch 54 and jam sensor switches 56 to 59 for effecting control in response to the signals. More specifically, the control system feeds a control signal to the drive motor 82 in one of the cases given below to drive the cutting device 12 downward from the upper limit position to the lower limit position and gives an alarm through a display 264.

(1) When the manual insertion mode is selected on the control panel 262.

(2) When the paper absence switch 52 detects absence of copy paper in the cassette 18.

(3) Upon the detection of a jam by one of the jam sensor switches 56 to 59.

The present embodiment has the following advantages.

(1) When the manual insertion mode is selected on the control panel 262, the cutting device 12 automatically descends to expose the copy paper inlet 28 on the front side, so that the operator can start to feed paper manually without following any other procedure.

(2) In the case where the paper absence switch 54 detects the absence of copy paper inside the cassette 18, the cutting device 12 automatically descends away from the location of withdrawing the cassette 18, so that the cassette 18 can be withdrawn for the replenishment of copy paper immediately without following any other procedure.

(3) Upon one of the jam sensor switches 56 to 59 detecting a jam, the cutting device 12 automatically descends away from the unit housing 60, with the result that the housing 60 can be immediately withdrawn toward the front for remedying the jam without following any other procedure.

The first to third embodiments can be modified as follows.

(1) Although the roll paper cutting device 12 is attached to the copying machine main body 10 movably upward and downward according to the foregoing embodiments, the device 12 needs only to be shiftable between the feed position and a position away from the feed position according to the present invention. Insofar as this requirement is fulfilled, the device 12 may be attached to the machine main body 10, for example, horizontally movably, or attached to the body 10 at the feed position.

(2) The drive motor 82 drives the cutting device 12 according to the above embodiments, whereas other drive means is usable according to the invention, or the device 12 may be moved manually. Furthermore, the drive means, the shift amount detecting means, and control means may be provided in the main body of the image forming apparatus.

(3) The first embodiment may be so modified that the cutting device 12 has incorporated therein not only the drive means therefor but also the guide rails 64 or like guide means, for example. The device 12 is then attachable to the image forming apparatus with greater ease and becomes more useful as an optional device.

(4) According to the third embodiment, the cutting device is so controlled as to be automatically shifted when the manual insertion mode is selected or upon detection of an abnormality such as a jam or absence of paper is detected. However, when the cutting device is made manually shiftable relative to the image forming apparatus, means needs only to be provided for notifying the operator of the need to shift the cutting device in these cases. The notice, if given, then eliminates the likelihood that the operator will forget to shift the cutting device to the standby position prior to the manual insertion mode (second feed mode), thus resulting in a remarkably improved efficiency for paper feeding. Further the abnormalities to be detected are not limited to those mentioned above. For example, toner absence detecting means may be provided for indicating a reduction in the amount of developer within the developing unit 32 so as to drive the device or give notice when the absence of toner is detected.

(5) Although the manual insertion mode has been described with reference to the foregoing embodiment as an example of mode wherein copy paper is fed from the inlet 28 by means other than the cutting device 12 (i.e. second feed mode), the second feed mode is not limited to the manual mode. For example, the inlet 28 can be provided with a paper cassette.

A fourth embodiment will be described below with reference to FIGS. 15 to 18.

Figure 15:
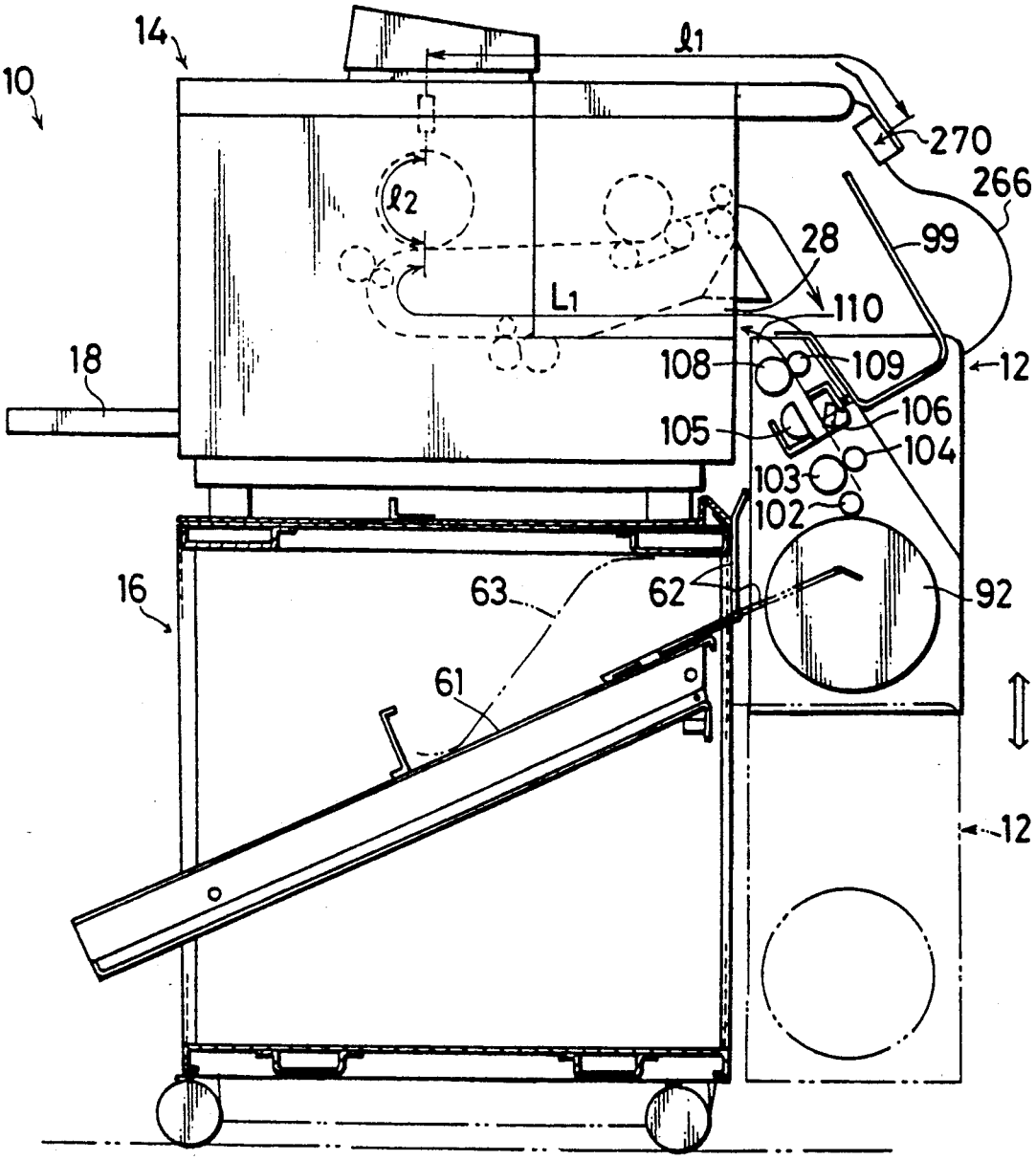
FIG. 15 is an overall diagram showing another image forming apparatus as a fourth embodiment.
Figure 16:
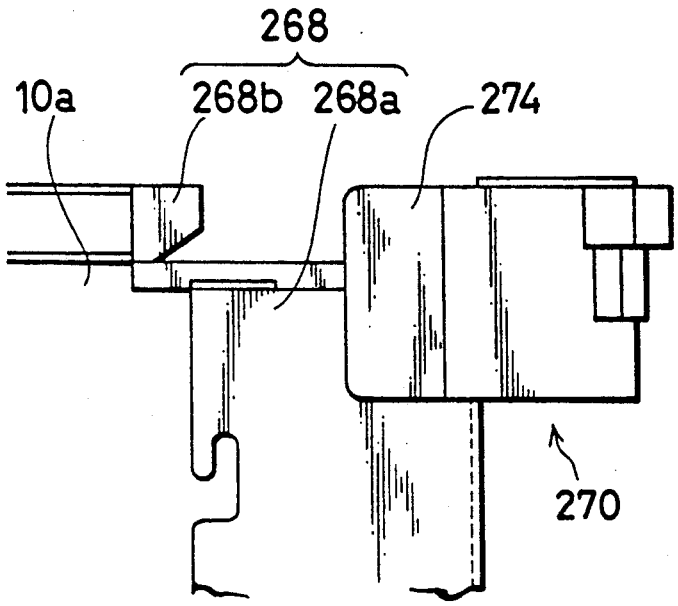
FIG. 16 is a plan view of rear end detecting means connected to the main body of a roll paper cutting device in the same embodiment.
Figure 17:
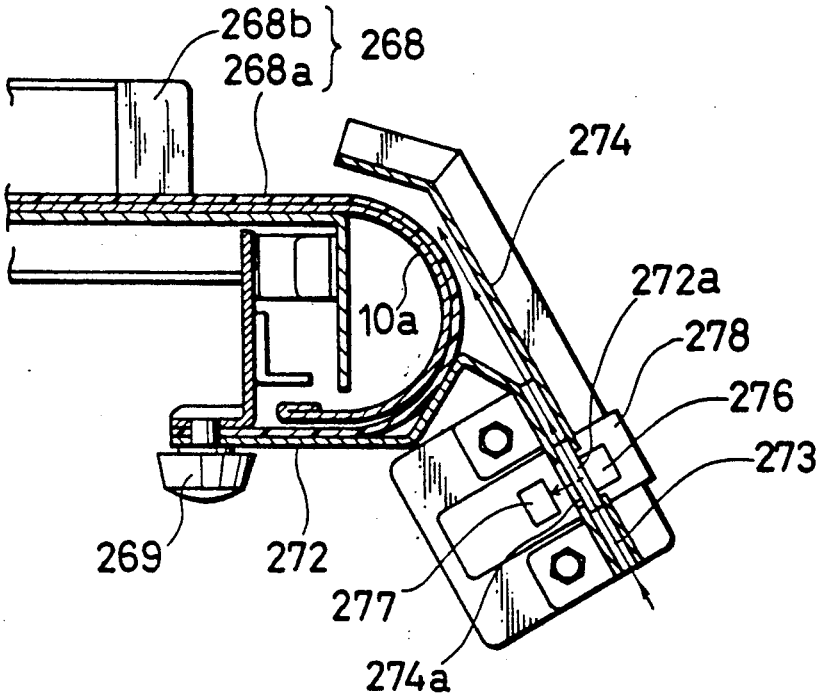
FIG. 17 is a side elevation in section of the rear end detecting means.

With this embodiment, document rear end detecting means 270 as shown in FIGS. 16 and 17 is connected by a lead wire 266 as shown in FIG. 15 to the same control system 90 as in the foregoing embodiments movably relative to the body of the roll paper cutting device 12.

With reference to FIGS. 16 and 17, indicated at 268 is a side restraining member (document guide) for regulating the position of documents widthwise thereof (vertically in FIG. 16). The restraining member 268 comprises a mount plate **268*a* shaped in conformity with the outer plate 10*a* of the copying machine main body 10, and a side restraining plate 268*b* extending upright from the mount plate 268*a*, and is provided at each of opposite sides (near side and remote side in FIG. 17) of the document feed path 42 (see FIG. 2). The mount plate 268*a* is attached to the machine body 10 with a pin 269 as shown in FIG. 17** slidably widthwise of documents.

On the other hand, the rear end detecting means 270 connected to the cutting device 12 has a mount bracket 272 and a document guide plate 274. The mount bracket (mount) 272 is fixed to the restraining member 268 by the pin 269.

The mount bracket 272 and the document guide plate 274 define therebetween a path (indicated by arrows in FIG. 17) 273 for documents to travel therealong. A light-emitting element 276 and a photodetector 277 are arranged at opposite sides of the path 273 to provide a photosensor serving as a rear end detector switch 278. The mount bracket 272 and the document guide plate 274 have holes **272*a*, 274*a*, respectively, as positioned in corresponding relation with the element 276 and the photodetector 277, such that the switch 278 is turned on or off by the presence or absence of the document blocking the light path. With reference to FIG. 15, the sum of the path length 11 from the position of detection by the rear end detector switch 278 to the position of exposure by the exposure unit 44 and the circumferential length 12 from the position where an image of the document is projected by the exposure unit 44 on the photosensitive drum 26 to the transfer position is made equal to the path length L1 from the cutting position of the cutters 105, 106 of the cutting device 12 to the transfer position, by selecting the position of the rear end detecting means 270**.

Figure 18:
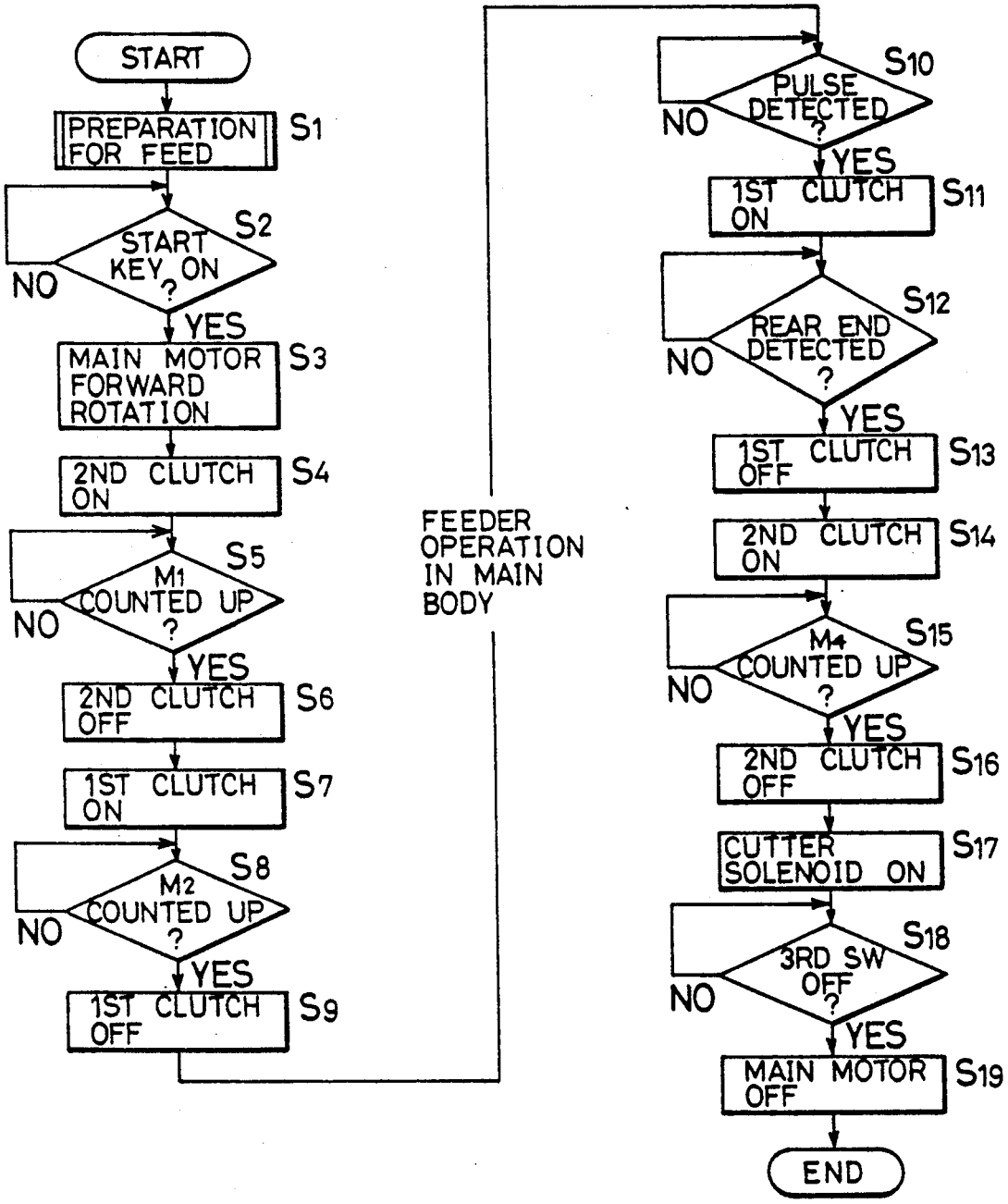
FIG. 18 is a flow chart showing the control operation to be performed by a control system for the cutting device.

Next with reference to FIG. 18, a description will be given of the control operation to be actually conducted by the control system 90 and the paper feed operation of the embodiment to be performed under the control.

The operation up to step S11 in the flow chart is the same as the corresponding operation in the flow charts of FIG. 9. The first clutch 98 is engaged (step S11) to operate the transport roller 95, and the rear end of the document being transported by the exposure unit 44 moves past the position of detection by the rear end detector switch 278, whereupon the switch 278, which is on, is turned off to apply the resulting signal to the control system 90. When the rear end of the document is detected in this way (YES in step S12 ), the control system 90 disengages the first clutch 98 (step S13) and engages the second clutch 114 (step S14) to drive the feed roller 103. Upon the pulse number of the detection signal from the rotation detector 144 reaching a predetermined pulse number M3 (YES in step S15), the system disengages the second clutch 114 (step S16). By the operation of these steps S14 to S16, the roll paper 92 within the cutting device 12 is transported by a length corresponding to the pulse number M3 at twice the feed speed in the machine main body 10. Consequently, the roll paper 92 is transported excessively by a distance corresponding to one-half of the pulse number M3, forming a warped portion upstream from the cutters 105, 106 so as to be cut with proper timing.

As described above, the roll paper cutting device 12 has connected thereto the rear end detecting means 270 for detecting the rear end of the document being transported in the machine main body 10, and the rear end detecting means 270 is positioned suitably in accordance with the internal structure of the main body 10, for the cutters 105, 106 to cut the roll paper with timing based on the time when the rear end is detected. Accordingly, the roll paper can be cut to a size for feeding in conformity with the document size at all times without the need for signal communication between the device and the machine main body. This obviates the need to modify an existing copying machine when the cutting device is to be used for the machine as the machine main body 10. The present embodiment also has the advantage that when the position of the rear end detecting means is suitably selected, the cutting device can be used for copying machines which differ variously in interior construction.

As is the case with the first embodiment, the cutting device 12 may be provided with the drive motor 82 for driving the device 12 itself, and the roll paper feed timing may be determined based on the rotation of the feed roller 103. The cutting device 12 can then be given enhanced optionality for use with the machine main body 10.

With the present embodiment, the roll paper 92 is warped to provide proper cutting timing, so that the sheet cut off from the roll paper 92 is longer than the document by an amount corresponding to the pulse number M3. If it is desired to make the sheet identical with the document in size, the rear end detecting means 270 may be positioned away from the exposure position a larger distance than in the above case by an amount corresponding to the pulse number M3.

Although the cutting operation is started simultaneously with the detection of the rear end according to the present embodiment, the cutting operation may be initiated, for example, a predetermined period of time after the detection of the rear end.

With the present embodiment, the user manipulates some of the number entry keys 132 to enter the roll paper transport speed and store the speed in the memory, whereas the serviceman may write the data in conformity with the machine main body.

Figure 19:
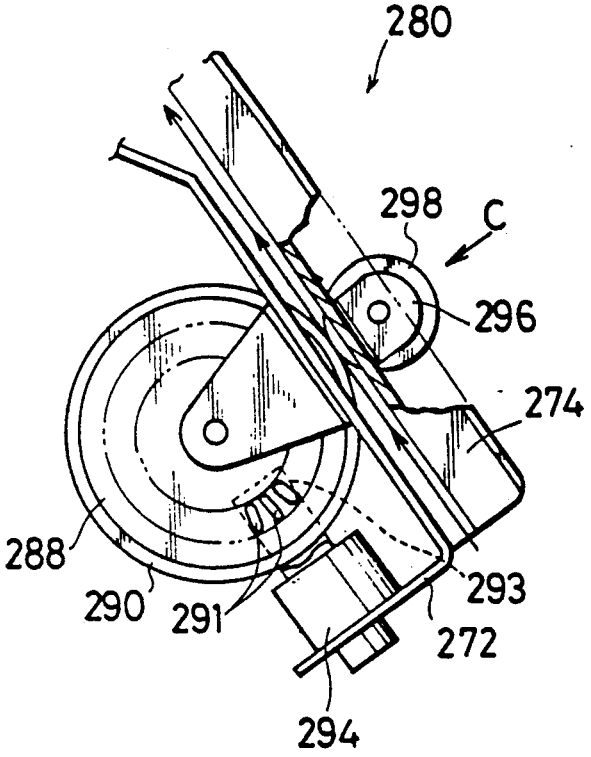
FIG. 19 is a side elevation in section showing rear end detecting means according to a fifth embodiment.
Figure 20:
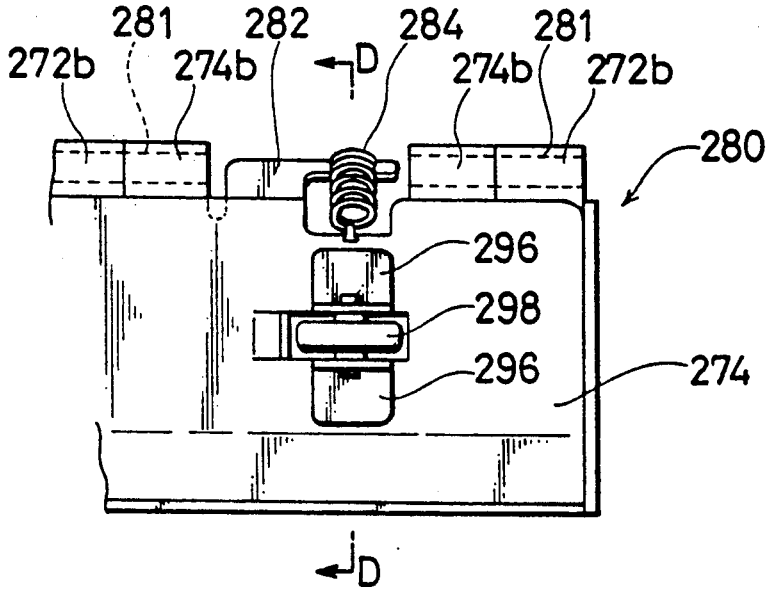
FIG. 20 is a view showing the same means as it is seen in the direction of arrow C in FIG. 19.
Figure 21:
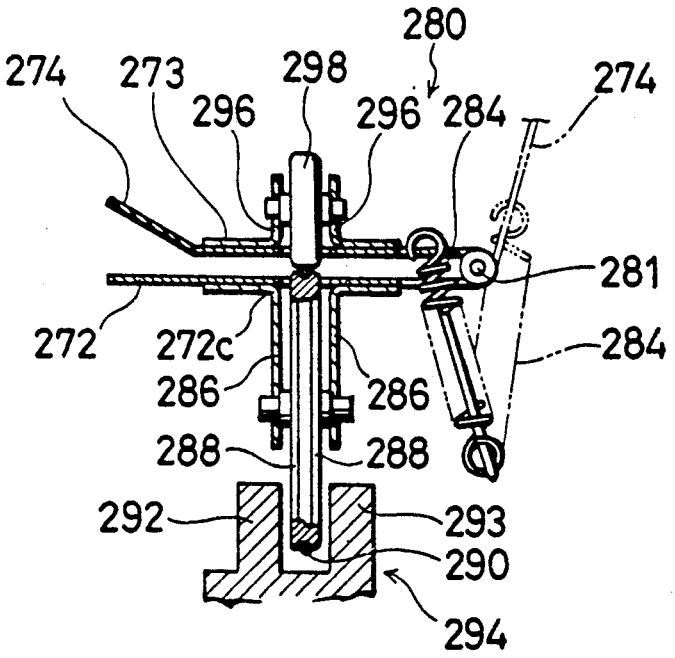
FIG. 21 is a view in section taken along the line D—D in FIG. 20.

A fifth embodiment will be described next with reference to FIGS. 19 to 21.

The illustrated rear end detecting means 280 has a mount bracket 272 and a document guide plate 274 which are provided with hinge portions 272*b*, 274*b*, respectively. The document guide plate 274 is pivotally movably connected to the mount bracket 272 by pins 281 extending through the hinge portions 272*b*, 274*b* (see the solid-line and phantom-line positions in FIG. 21). The mount bracket 272 is partly bent downward to provide a spring retainer 282. The forward end of the spring retainer 282 is connected to the base end of the guide plate 274 by a tension spring (holding means) 284.

A pulse roller (rotary member) 288 is rotatably mounted by a pair of support members 286 on the mount bracket 272 and has an upper end projecting into a document channel 273 through a hole 272*c* formed in the mount bracket 272. An antiskid O-ring 290 is fixedly fitted in the outer periphery of the pulse roller 288, which is formed immediately inwardly of the ring with a multiplicity of slits 291 as uniformly arranged side by side circumferentially. At the opposite sides of the arrangement of slits 291, a light-emitting element 292 and a photosensor 293 are arranged to provide a photosensor serving as a rear end sensor (signal output means) 294. The sensor 294, which is fixed to the mount bracket 272 is connected to the control system 90 shown in FIG. 7. For the sake of convenience, FIG. 21 shows the sensor 294 as revolved through 90 degrees clockwise in FIG. 19 from the actual position.

A roller 298 is also rotatably mounted by a pair of support members 296 on the document guide plate 274. With the guide plate 274 in its closed state, the roller 298 is held in pressing contact with the pulse roller 288 by the force of the tension spring 284.

The operation of the rear end detecting means 280 will be described next. First, the document guide plate 274 is opened against the force of the tension spring 284, the lower surface of a document is placed at each of its opposite sides in contact with the 0-ring 290 on the pulse roller 288, and the guide plate 274 is then closed in this state. When thus set, the document is held on its front and rear sides by the roller 298 and the 0-ring 290.

When transport of the document in this state is started, the travel of the document rotates the roller 298 and the pulse roller 288 in contact therewith, causing the pulse roller 288 to intermittently block the light path of the rear end sensor 294, which in turn feeds a pulse signal to the control system 90. Upon the rear end of the document passing over the pulse roller 288, the pulse roller 288 stops, no longer producing any pulse signal, whereby the document rear end can be detected.

Figure 22:
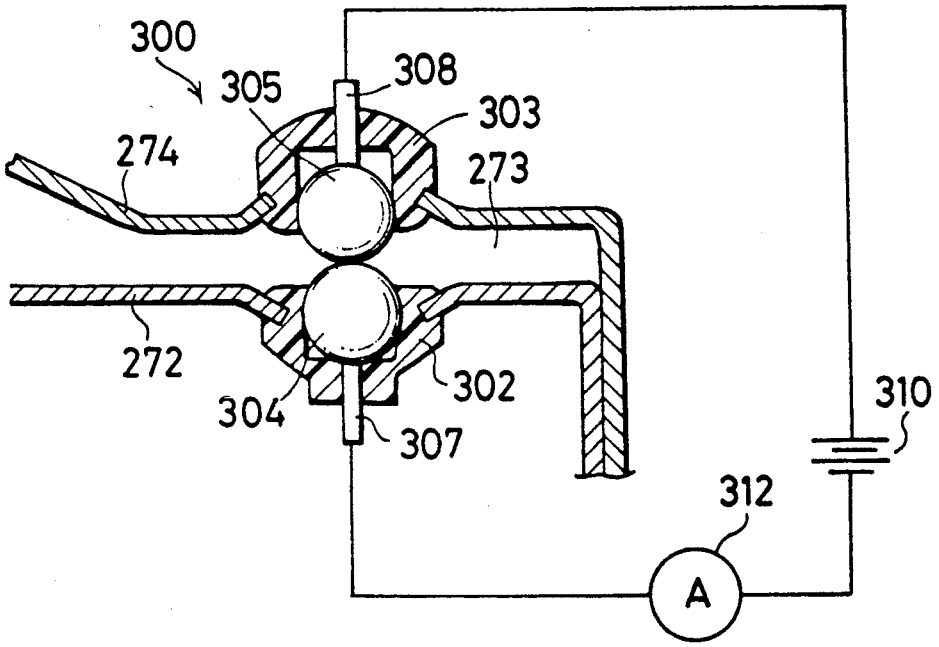
FIG. 22 is a sectional view of a rear end detecting means according to a sixth embodiment.

Next, a sixth embodiment will be described with reference to FIG. 22.

The illustrated rear end detecting means 300 has a mount bracket 272 and a document guide plate 274 which are fixedly provided with insulating holding members 302, 303, respectively. These members are open toward a document channel 273. These holding members 302, 303 have rollably supported therein electrically conductive balls (conductive members) 304, 305, respectively, which are made of metal or like conductive material. Under gravity, the upper ball 304 is in contact with the lower ball 305. Electrode members 307, 308 made of a conductive material are fixedly provided as positioned always in contact with the balls 304, 305, respectively. A d.c. power supply (voltage generator means) 310 is connected between the electrode members 307, 308, and an ammeter (current sensor means) 312 is incorporated into the circuit.

When a document which is an insulating article is inserted between the two conductive balls 304, 305 of the present embodiment, almost no current flows between the electrode members 307, 308, whereas upon the rear end of the document moving past the two balls 304, 305, current normally flows again. The document rear end can therefore be detected from the current change.

The present invention is not limited to the above embodiments. For example, a limit switch or the like may be used as the rear end detecting means. The roll paper cutting device 12 is satisfactorily serviceable insofar as it is capable of feeding roll paper into the copying machine main body 10. The inside construction of the device or the structure for attach-ing the device to the machine main body 10 is not limited to those of the foregoing embodiments.

Next, a seventh embodiment will be described with reference to FIGS. 23 to 26.

Figure 23:
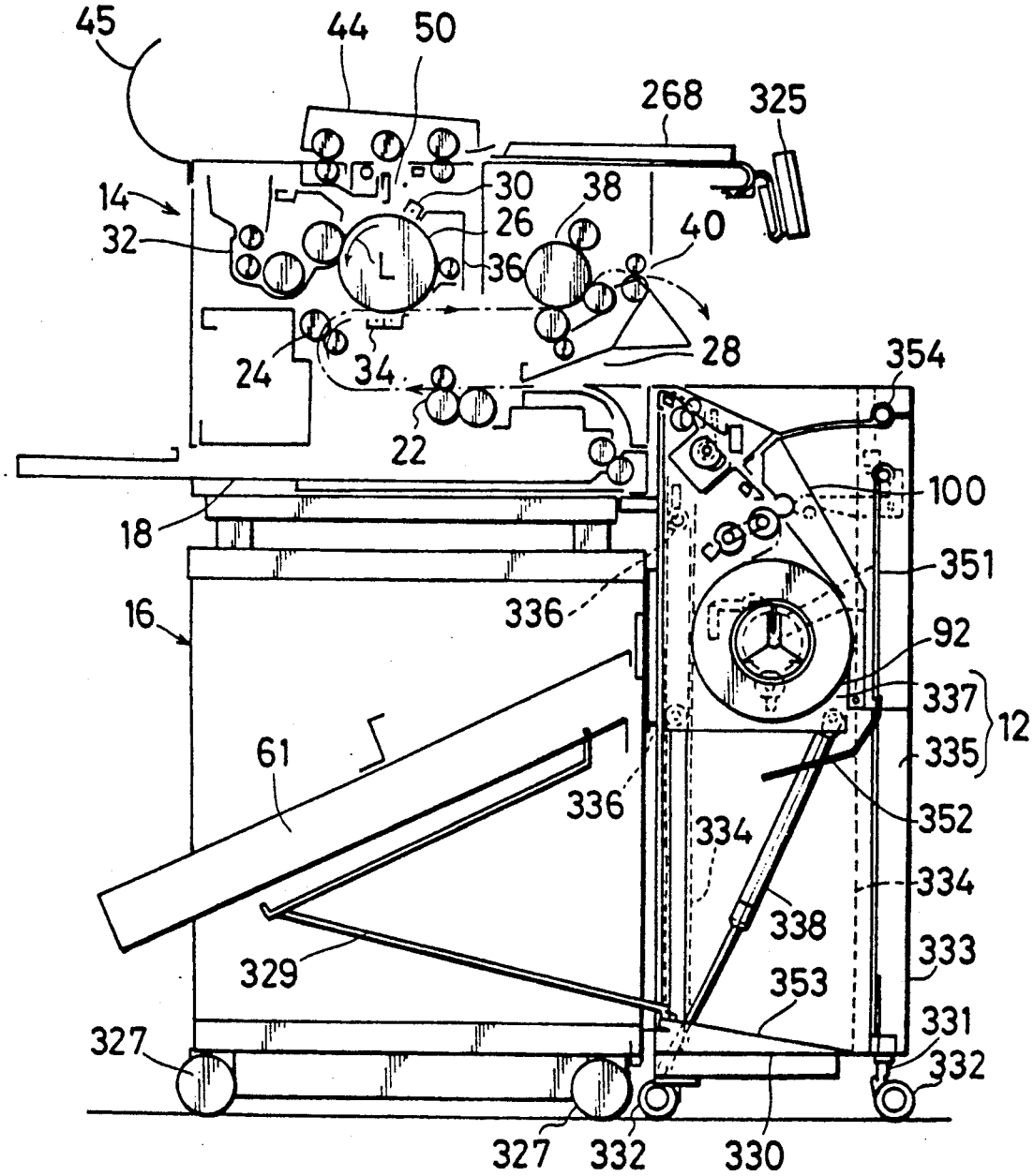
FIG. 23 is an overall diagram showing another image forming apparatus as a seventh embodiment.
Figure 24:
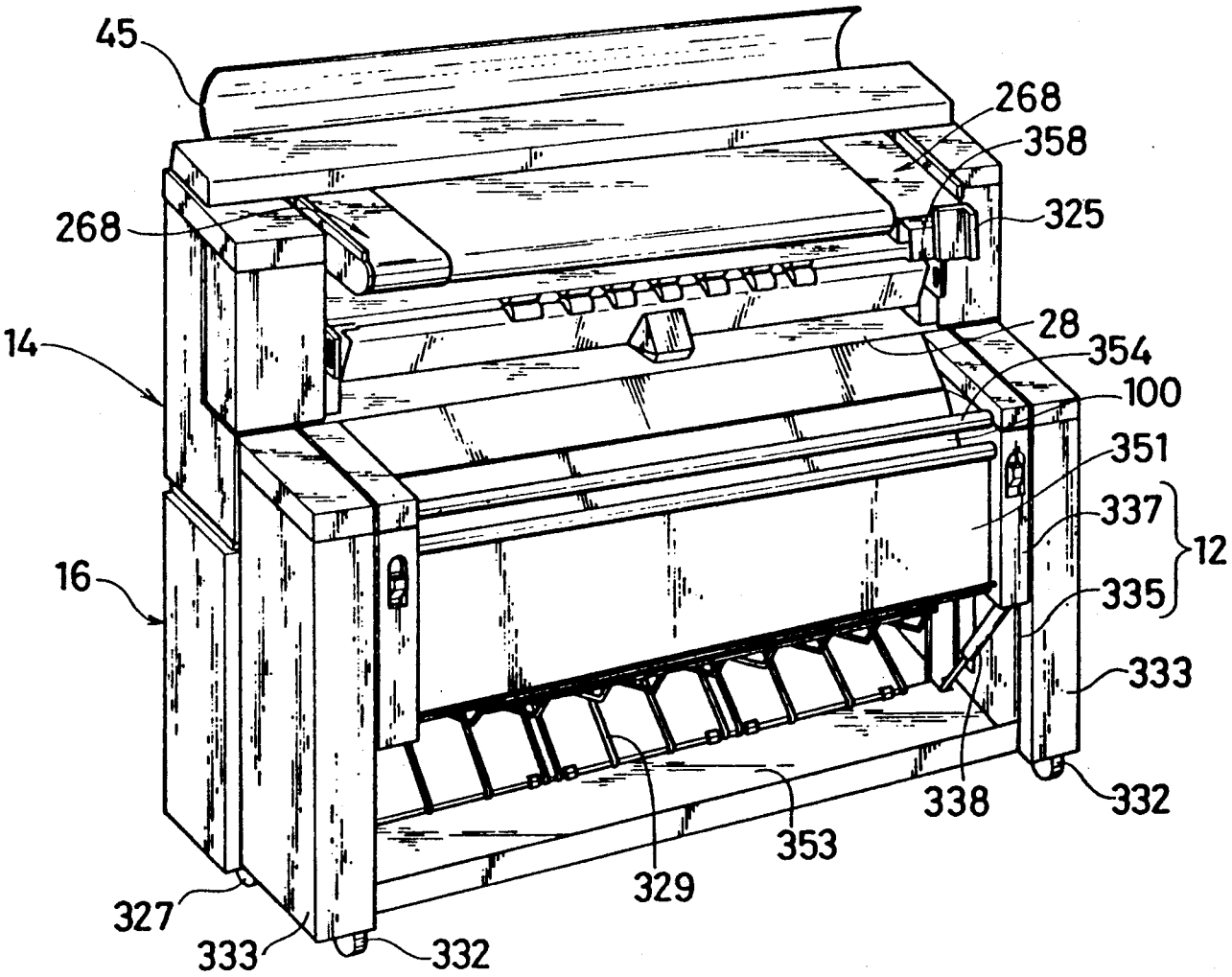
FIG. 24 is an overall perspective view of the same image forming apparatus.

Referring to FIG. 23, a roll paper cutting device 12 has a bottom frame 330, and wheels 332 attached by screw stems 331 to the respective four corners of the bottom of the frame 330. Vertical frames 333 extend upright from opposite sides of the bottom frame 330.

Each of the vertical frames 333 is provided at each of its front and rear portions with a guide member 334 extending vertically. Thus, a unit framework 335 is constructed which is freely movable to an adjusted level. A unit body 337 has at its upper and lower portions rollers 336 which are rollable along the guide members 334. The bottom frame 330 and the unit body 337 are interconnected at each of its opposite sides by a gas spring 338 serving as holding means for biasing and holding the unit body 337 vertically movably. The cutting device 12 is equivalent to those of the foregoing embodiments in internal construction.

The cutting device 12 is provided at a suitable portion with a guide plate 351 for defining a paper discharge channel along with a cover 100 thereof, and with a guide member 352 for guiding cut paper toward the copy paper stocking frame 16 when the paper is delivered through the discharge channel. Indicated at 353 is a platelike guide member flush with a bent guide member 329 disposed in the stocking frame 16, at 354 a handlebar extending horizontally at the front upper portion of the unit body 337, and at 327 casters attached to the bottom of the stocking frame 16.

The present embodiment has side restraining members 268 and rear end detecting means 325, which will be described in detail with reference also to FIGS. 25 and 26. The present embodiment has a mount structure for attaching the rear end detecting means 325 to the side restraining member 268 shiftably.

Figure 25:
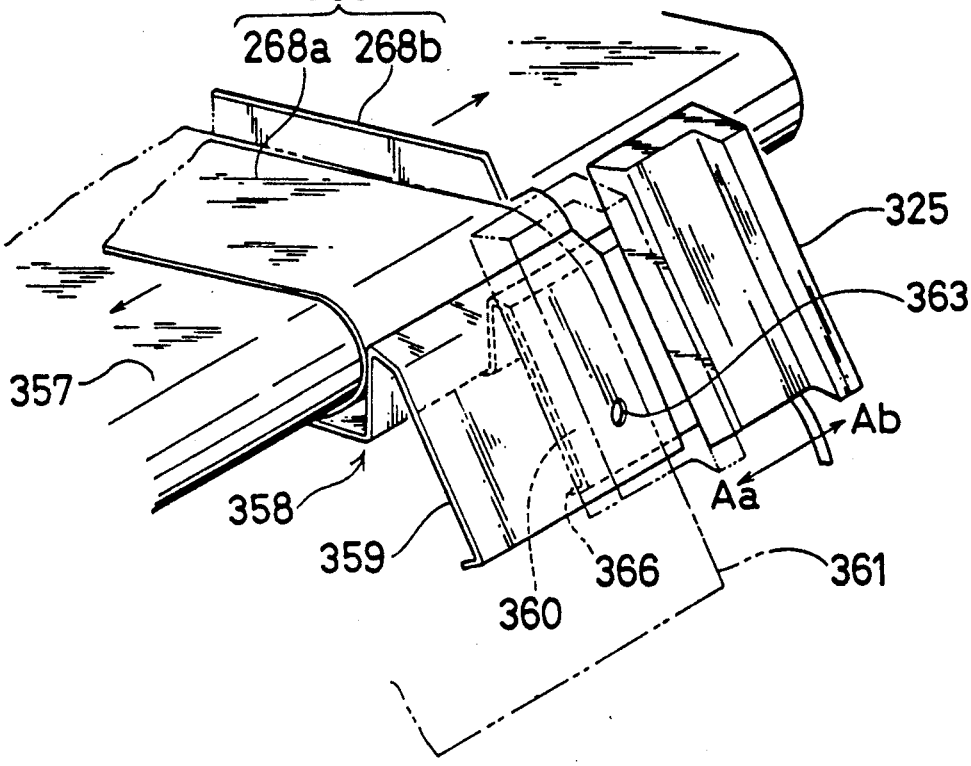
FIG. 25 is a perspective view showing an example of mount structure for rear end detecting means and a document guide in the same apparatus.
Figure 26:
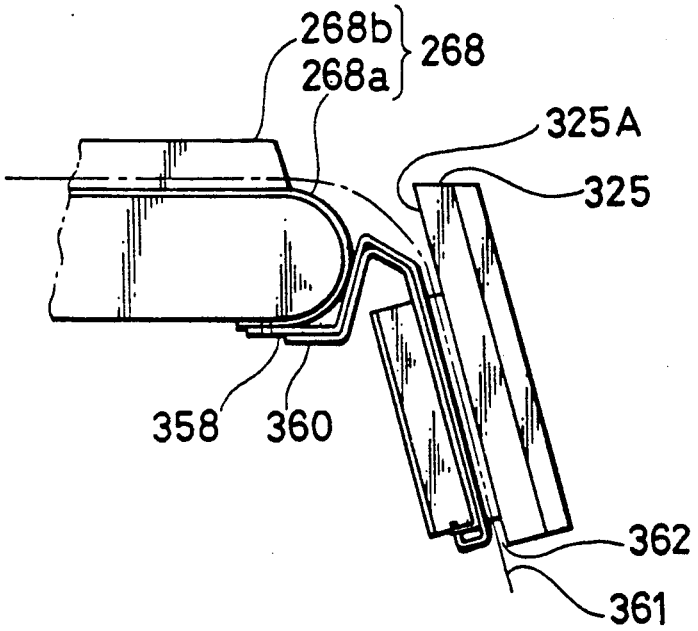
FIG. 26 is a sectional view showing the same mount structure.

The side restraining members 268, each comprising a mount plate 268*a* and a side restraining plate 268*b*, are mounted on the right and left sides (only the right side is shown in FIG. 25) of a document support portion 357 provided on the front side of the main body 10 of a copying machine, and are movable toward or away from each other as by a rack-pinion mechanism. Indicated at 358 is a mount plate, which is held to the lower portion of the mount plate 268*a* of the side restraining member 268 as by screws so as to be movable with the restraining member 268. The mount plate 358 has a mount main portion 359 which is inclined at a suitable angle.

On the other hand, the rear end detecting means 325 of the present embodiment has, for example, a sensor of the reflection type (not shown in the drawings) therein and is supported by a slide plate 360 which is bent so as to be coextensive with the mount plate 358. The detecting means 325 is selectively shiftable to a first position for detecting a document 361 or to a second position (retracted position outward from the first position) where the detecting means 325 does not interfere with the document 361 to be inserted, by moving the slide plate 360 on the rear side of the mount main portion 359 toward the direction of arrow Aa or Ab shown in FIG. 25. The detecting face 325A of the detecting means 325 and the front surface of the mount main portion 359 define a document passage 362 for the document 361 to pass through. A hole 363 is formed in the mount main portion 359 with facing the sensor of the reflection type so that the sensor can detect the document 361 through the hole 363.

The slide plate 360 can be temporarily held in a specified position to prevent the detecting means 325 from readily moving sidewise. Also, the slide plate 360 is prevented from slipping off the mount plate 358 even when moved in the direction of arrow Ab.

When the rear end detecting means 325 is not used, that is, when documents are fed manually, the side restraining members 268 are moved and set in posi-tion in conformity with the width of the document 361. restraining member 268. When the slide plate 360 in this state is pulled outward a specified distance in the direction of arrow Ab in FIG. 25, the plate spring 363 engages in the outer positioning groove 364 to lock the slide plate 360 in position, whereby the rear end detecting means 325 can be held retracted at the second position where the means 325 will not interfere with the document 361 to be inserted, thus permitting smooth insertion of the document 361.

When the detecting means 325 is to be used, the slide plate 360 is pushed inward by a predetermined distance in the direction of arrow Aa in FIG. 25. This causes the plate spring 363 to engage in the inner positioning groove 364 to lock the slide plate 360 in place, whereby the detecting means 325 can be set in the first position for detecting the document 361. Thus, the rear end of the document 361 can be detected reliably.

When the rear end of the document 361 is to be detected by the means 325, the detecting means 325 need not be made ready for detection before the insertion of the document 361 but may be made ready for detection by the time the document moves past the means 325.

Although the rear end detecting means 325 is slidable sidewise for shifting according to the present embodiment, the means 325 may be shifted, for example, by being rotated through 90 degrees.

Figure 27:
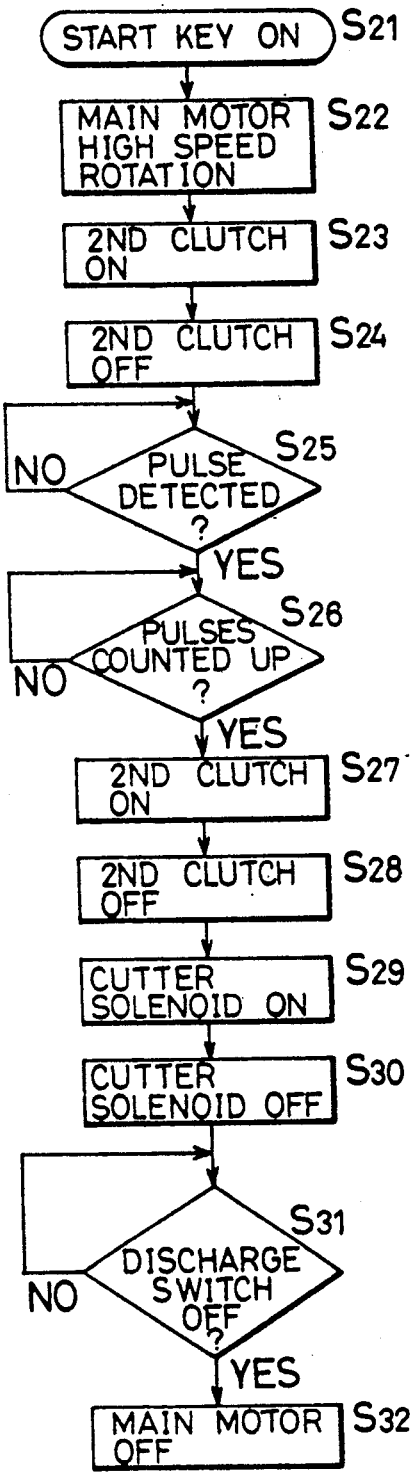
FIG. 27 is a flow chart for illustrating the operation to be performed in a roll paper feed mode by another image forming apparatus as an eighth embodiment.

Next, an eighth embodiment will be described with reference to the flow chart of FIG. 27. With the cutting device 12 of the first embodiment set in the roll paper feed mode, the device 12 is initially driven to deliver the roll paper 92, and after the leading end of the roll paper 92 has reached the pair of feed rollers 22 within the copying machine main body 10, the paper is transported to the image forming assembly including the drum 26, etc. only by the transport means within the main body 10. The control system 90 of the cutting device 12 is so adapted as to effect the above mode of control.

Stated more specifically, the start key 136 on the control panel 130 is depressed (step S21), causing the main motor 122 within the device 12 to rotate at a high speed in the specified direction (step S22). In this state, the second clutch 144 is engaged (step S23) to drive the feed roller 103, forwarding the leading end of the roll paper 92 toward the copy paper inlet 28 of the main body 10 via the outlet 110.

Upon the pulse count of the pulse signal produced from the rotation detector 14 reaching a predetermined pulse number, the second clutch 114 is disengaged (step S24). At this time, the leading end of the roll paper 92 has been transported to the position of the pair of feed rollers 22 of the main body 10.

The pair of feed rollers 22 within the main body 10 thereafter starts to feed the paper, upwardly pulling the roll paper portion within the cutting device 12 and rotating the feed rollers 103, 104 which are in contact with the paper 92. The rotation is detected by the rotation detector 144 (YES in step S25). Upon the pulse count reaching a predetermined pulse number (YES in step S26), the second clutch 114 is engaged again (step S27), rotating the feed roller 103 to transport the roll paper 92 The second clutch 114 is disengaged upon the pulse count of the rotation detecting signal from the rotation detector 144 reaching a specified pulse number (step S28). The roll paper portion upstream from the cutters 105, 106 is warped so that the roll paper 92 is to be cut with proper timing.

The cutter solenoid 120 is then energized (step S29), whereby the cutter 105 is rotated one turn to cut the roll paper 92. The solenoid is then de-energized (step S30). The rear end of the cut sheet of roll paper 92 thereafter moves past the third switch (discharge switch) 140 to turn off the switch 140 (YES in step S31), whereupon the main motor 122 is deenergized (step S32), whereby the paper feed operation is completed.

Thus, the roll paper 92 is transported only by the feed operation of the copying machine main body 10 after the operation has been started. This obviates the likelihood of the roll paper 92 warping or being tensioned during transport.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construded as being included therein.

What we claim is:

1. An image forming apparatus comprising an image forming apparatus main body having a sheet inlet and adapted to form an image on a sheet inserted from the sheet inlet, and a roll paper cutting device containing roll paper and adapted to cut the roll paper and discharge the cut sheet to the outside from an outlet, the cutting device being attachable to the apparatus main body to be selectively in a feed position where the outlet is in register with the sheet inlet or in a standby position wherein the outlet is out of register with the sheet inlet, and further comprising guide means on said main body for guiding said cutting device in the vertical direction between said feed position and said standby position.

2. An image forming apparatus comprising an image forming apparatus main body having a sheet inlet and adapted to form an image on a sheet inserted from the sheet inlet, and a roll paper cutting device containing roll paper and adapted to cut the roll paper and discharge the cut sheet to the outside from an outlet, the cutting device being so attachable to the apparatus main body as to be selectively in a feed position where the outlet is in register with the sheet inlet or in a standby position wherein the outlet is out of register with the sheet inlet, the apparatus main body being provided with a sheet guide member shiftable between a guide position in which the sheet guide member projects out from the apparatus main body to guide sheets to a sheet stacking position when the cutting device is in the standby position and a retracted position in which the sheet guide member is retracted from the cutting device when the device is in the feed position.

3. An image forming apparatus comprising an image forming apparatus main body having a sheet inlet and adapted to form an image on a sheet inserted form the sheet inlet, and a roll paper cutting device containing roll paper and adapted to cut the roll paper and discharge the cut sheet to the outside from an outlet, the cutting device being so attachable to the apparatus main body as to be selectively in a feed position where the outlet is in register with the sheet inlet or in a standby position wherein the outlet is out of register with the sheet inlet, the roll paper cutting device being attached to the apparatus main body so as to be shiftable between the feed position and the standby position.

4. An image forming apparatus as defined in claim 3 wherein the apparatus main body is provided with a sheet guide member shiftable between a guide position in which the sheet guide member projects out from the apparatus main body to guide sheets to a sheet stocking portion when the cutting device is in the standby position and a retracted position in which the sheet guide member is retracted from the cutting device when the device is in the feed position

5. An image forming apparatus as defined in claim 4 wherein the sheet guide member is pivotally movable about its lower end between the retracted position and the guide position, and a holding member is provided for holding the sheet guide member in the feed position.

6. An image forming apparatus as defined in claim 5 wherein the sheet guide member is provided at a position permitting the guide member to be held in the retracted position by the cutting device when the device is in the feed position and permitting the guide member to return to the guide position when the device is in the standby position

7. An image forming apparatus as defined in claim 4 which is provided with a drive conversion mechanism for converting the shift of the roll cutting device to the shift of the sheet guide member, positioning the sheet guide member in the retracted position when the cutting device is in the feed position and positioning the sheet guide member in the guide position when the cutting device is in the standby position.

8. A roll paper cutting device attachable to the main body of an image forming apparatus as defined in claim 3, the cutting device comprising drive means for shifting the cutting device itself relative to the appara-tus main body when the device is attached to the apparatus main body.

9. A roll paper cutting device as defined in claim 8 which comprises means for detecting the amount of shift of the device itself, and control means for controlling the operation of the drive means based on the amount of shift detected.

10. An image forming apparatus as defined in claim 3 which comprises mode input means for selecting as a paper feed mode a first feed mode wherein paper is fed from the cutting device or a second feed mode wherein paper is fed through the sheet inlet by means other than the cutting device, and means for notifying the operator to shift the cutting device to the standby position when the second feed mode is selected by the mode input means.

11. An image forming apparatus as defined in claim 10 wherein the second feed mode is a manual insertion mode wherein sheets are inserted from the sheet inlet.

12. An image forming apparatus as defined in claim 3 which comprises abnormality detecting means for detecting the image forming apparatus becoming abnormal, and means for notifying the operator to shift the cutting device to the standby position upon the abnormality detecting means detecting the apparatus becoming abnormal.

13. An image forming apparatus as defined in claim 12 wherein the apparatus main body has a sheet container containing sheets and is adapted to form an image selectively on one of the sheet inserted from the sheet inlet and the sheet fed from the sheet container, the cutting device being attached to the apparatus main body and shiftable between the feed position where the outlet of the device is in register with the sheet inlet of the apparatus main body and the standby position wherein the outlet is away from the location of withdrawal of the sheet container, the abnormality detecting means being sheet detecting means for detecting the presence of sheets in the container, the notifying means being adapted to notify the operator to shift the cutting device to the standby position upon the sheet detecting means detecting the absence of sheets in the container.

14. An image forming apparatus as defined in claim 12 wherein a portion of the apparatus main body is withdrawable to remedy jams with the main body portion withdrawn, and the cutting device is attached to the apparatus main body and shiftable between the feed posi-tion where the outlet of the device is in register with the sheet inlet of the apparatus main body and the standby position wherein the outlet is away from the location of withdrawal of the main body portion, the abnormality detecting means being jam detecting means for detecting a jam occurring in the apparatus main body, the notifying means being adapted to notify the operator to shift the cutting device to the standby position upon the jam detecting means detecting the occurrence of a jam.

15. An image forming apparatus as defined in claim 3 which comprises drive means for shifting the cutting device.

16. An image forming apparatus as defined in claim 15 which comprises means for detecting the amount of shift of the cutting device, and control means for controlling the operation of the drive means based on the amount of shift detected.

17. An image forming apparatus as defined in claim 15 which comprises mode input means for selecting as a paper feed mode a first feed mode wherein paper is fed from the cutting device or a second feed mode wherein paper is fed through the sheet inlet by means other than the cutting device, and control means for shifting the cutting device to the standby position when the second feed mode is selected by the input means.

18. An image forming apparatus as defined in claim 17 wherein the second feed mode is a manual insertion mode wherein sheets are inserted from the sheet inlet.

19. An image forming apparatus as defined in claim 15 which comprises abnormality detecting means for detecting the image forming apparatus becoming abnormal, and control means for shifting the cutting device to the standby position upon the abnormality detecting means detecting the apparatus becoming abnormal.

20. An image forming apparatus as defined in claim 19 wherein the apparatus main body has a sheet container containing sheets and is adapted to form an image selectively on one of the sheet inserted from the sheet inlet and the sheet fed from the sheet container, the cutting device being attached to the apparatus main body and shiftable between the feed position where the outlet of the device is in register with the sheet inlet of the apparatus main body and the standby position where the outlet is away from the location of withdrawal of the sheet container, the abnormality detecting means being sheet detecting means for detecting the presence of sheets in the container, the control means being adapted to shift the cutting device to the standby position upon the sheet detecting means detecting the absence of sheets in the container.

21. An image forming apparatus as defined in claim 19 wherein a portion of the apparatus main body is withdrawable to remedy jams with the main body portion withdrawn, and the cutting device is attached to the apparatus main body and shiftable between the feed position where the outlet of the device is in register with the sheet inlet of the apparatus main body and the standby position where the outlet is away from the location of withdrawal of the main body portion, the abnormality detecting means being jam detecting means for detecting a jam occurring in the apparatus main body, the control means being adapted to shift the cutting device to the standby position upon the jam detecting means detecting the occurrence of a jam.

22. An image forming apparatus comprising an image forming apparatus main body having a sheet inlet and adapted to form an image on a sheet inserted from the sheet inlet, and a roll paper cutting device containing roll paper and adapted to cut the roll paper and discharge the cut sheet to the outside from an outlet, the cutting device being so attachable to the apparatus main body as to be selectively in a feed position where the outlet is in register with the sheet inlet or in a standby position wherein the outlet is out of register with the sheet inlet, the cutting device being provided with a document discharge tray for receiving documents discharged from the apparatus main body when the cutting device is in the feed position.

23. A roll paper cutting device attachable to an image forming apparatus main body for forming an image of a document fed to an exposure unit on a sheet and adapted to feed roll paper in a cut state into the apparatus main body, the cutting device comprising a main body containing the roll paper, means for transporting the roll paper, a cutter for cutting the roll paper during transport, rear end detecting means connected to the cutting device main body and provided in the path of transport of documents in the image forming apparatus main body for detecting the rear end of the document, and control means for cutting the roll paper with predetermined timing based on the time when the document rear end is detected by the detecting means, said image forming apparatus comprising first controller means for controlling copying operations of the image forming apparatus, feeding means at a predetermined position in the image forming apparatus and responsive to said first controller for temporarily holding the transported roll paper and feeding the roll paper further when a copying operation is started, the transporting means of the cutting device being mounted to transport the roll paper to said predetermined position of the image forming apparatus, said control means comprising second controller means responsive to the rear end detecting means for controlling the cutter to cut the roll paper when the document rear end is detected by said detecting means.

24. An image forming apparatus which comprises a roll paper cutting device as defined in claim 23 and an image forming apparatus main body having a sheet inlet and adapted to form an image on a sheet inserted from the sheet inlet, the cutting device being so attached to the apparatus main body as to be selectively in a feed position where an outlet of the cutting device feeds roll paper into the apparatus main body or in a standby position away from the feed position.

25. A roll paper cutting device attachable to an image forming apparatus main body for forming an image of a document fed to an exposure unit on a sheet and adapted to feed roll paper in a cut state into the apparatus main body, the cutting device comprising a main body containing the roll paper, means for transporting the roll paper, a cutter for cutting the roll paper during transport, rear end detecting means connected to the cutting device main body and provided in the path of transport of documents in the image forming apparatus main body for detecting the rear end of the document, and control means for cutting the roll paper with predetermined timing based on the time when the document rear end is detected by the detecting means, the rear end detecting means having a mount portion attachable to a document guide on the image forming apparatus main body.

26. A roll paper cutting device as defined in claim 25 which has a mount structure for attaching the rear end detecting means to the document guide shiftably between a first position for detecting the document to be guided by the document guide and a second position where the rear end detecting means does not interfere with the document to be inserted.

27. A roll paper cutting device attachable to an image forming apparatus main body for forming an image of a document fed to an exposure unit on a sheet and adapted to feed roll paper in a cut state into the apparatus main body, the cutting device comprising a main body containing the roll paper, means for transporting the roll paper, a cutter for cutting the roll paper during transport, rear end detecting means connected to the cutting device main body and provided in the path of transport of documents in the image forming apparatus main body for detecting the rear end of the document, and control means for cutting the roll paper with predetermined timing based on the time when the document rear end is detected by the detecting means, the rear end detecting means being attachable to the apparatus at a position which is so determined that the distance from the rear end detecting position to the image forming position in the main body of the apparatus is equal to the distance from the roll paper cutting position in the cutting device to the image forming position.

* * * * *